US011987433B2

(12) United States Patent
Zacherle et al.

(10) Patent No.: US 11,987,433 B2
(45) Date of Patent: May 21, 2024

(54) ARTICLE CARRIER AND BLANK THEREFOR

(71) Applicant: WestRock Packaging Systems, LLC, Atlanta, GA (US)

(72) Inventors: Matthew E. Zacherle, Chesterfield, VA (US); Julien D. Merzeau, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 222 days.

(21) Appl. No.: 17/431,023

(22) PCT Filed: Feb. 11, 2020

(86) PCT No.: PCT/US2020/017605
§ 371 (c)(1),
(2) Date: Aug. 13, 2021

(87) PCT Pub. No.: WO2020/167719
PCT Pub. Date: Aug. 20, 2020

(65) Prior Publication Data

US 2022/0119178 A1 Apr. 21, 2022

Related U.S. Application Data

(60) Provisional application No. 62/806,166, filed on Feb. 15, 2019.

(51) Int. Cl.
*B65D 71/58* (2006.01)

(52) U.S. Cl.
CPC ..... *B65D 71/0022* (2013.01); *B65D 2571/00141* (2013.01); *B65D 2571/00197* (2013.01);
(Continued)

(58) Field of Classification Search
CPC .... B65D 71/00; B65D 71/0022; B65D 71/58; B65D 75/00; B65D 2571/00141;
(Continued)

(56) References Cited

U.S. PATENT DOCUMENTS 2,821,328 A 1/1958 Ramsay
4,735,315 A 4/1988 Oliff et al.
(Continued)

FOREIGN PATENT DOCUMENTS

EP 1365970 B1 8/2006
WO 2012109096 A1 8/2012
WO 2018080962 A1 5/2018

*Primary Examiner* — Bryon P Gehman
(74) *Attorney, Agent, or Firm* — Brian J. Goldberg; Rohini K. Garg

(57) ABSTRACT

Aspects of the disclosure relate to an article carrier for packaging a plurality of articles, a blank for forming the article carrier. The article carrier comprises a plurality of primary panels for forming a tubular structure and defining an interior thereof. The plurality of primary panels includes a first panel and a second panel opposing the first panel. The article carrier further comprises a partition structure for dividing the interior into two or more article-receiving cells. The partition structure is formed from the first panel and comprises a lateral partition panel. The lateral partition panel is hingedly connected at a proximal end to the first panel by a proximal end fold line and is hingedly connected at a distal end to a glue panel by a distal end joint.

20 Claims, 16 Drawing Sheets

(52) U.S. Cl.
CPC ..... *B65D 2571/00388* (2013.01); *B65D 2571/00487* (2013.01); *B65D 2571/0066* (2013.01); *B65D 2571/00753* (2013.01); *B65D 2571/00845* (2013.01); *B65D 2571/0087* (2013.01)

(58) Field of Classification Search
CPC ..... B65D 2571/00197; B65D 2571/00388; B65D 2571/00487; B65D 2571/0066; B65D 2571/00753; B65D 2571/00845; B65D 2571/0087
USPC ..... 206/180, 434
See application file for complete search history.

(56) References Cited

U.S. PATENT DOCUMENTS

| | | | | |
|---|---|---|---|---|
| 5,072,876 | A | 12/1991 | Wilson | |
| 6,168,013 | B1 * | 1/2001 | Gomes | B65D 71/0022 206/180 |
| 6,571,941 | B2 * | 6/2003 | Holley, Jr. | B65D 71/0022 206/434 |
| 8,863,952 | B2 | 10/2014 | Bates et al. | |
| 9,415,914 | B2 | 8/2016 | Holley, Jr. | |
| 2007/0151873 | A1 | 7/2007 | Schuster | |
| 2015/0225155 | A1 * | 8/2015 | Ikeda | B65D 71/18 206/434 |
| 2016/0101923 | A1 | 4/2016 | Costanzo | |
| 2019/0248557 | A1 | 8/2019 | James et al. | |

* cited by examiner

ARTICLE CARRIER AND BLANK THEREFOR

TECHNICAL FIELD

The present invention relates to carriers and to blanks for forming the same. More specifically, but not exclusively, the invention relates to a carrier having a partition structure feature defining cells or compartments within an interior of a carrier of the basket-style.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present invention to provide to a carrier having a structure including at least one bevel or corner panel. It is desirable to simplify construction of the carrier and to reliably and consistently erect the structure of the carrier.

The present invention seeks to provide an improvement in the field of cartons, typically formed from paperboard or the like.

SUMMARY

A first aspect of the invention provides an article carrier for packaging one or more articles comprising a collapsible tubular structure which comprises a first primary panel, a second primary panel, a third primary panel and a fourth primary panel wherein the first and second primary panels are hingedly connected by a first hinged connection, the second and third primary panels are hingedly connected by a second hinged connection, the third and fourth primary panels are hingedly connected by a third hinged connection, the fourth and first primary panels are hingedly connected by a fourth hinged connection, and wherein the first hinged connection is greater in fold resistance than each of the second and fourth hinged connections.

Optionally, the third hinged connection is greater in fold resistance than each of the second and fourth hinged connections.

Optionally, the first hinged connection is substantially equal in fold resistance to the third hinged connection.

Optionally, the second hinged connection is substantially equal in fold resistance to the fourth hinged connection.

Optionally, the second primary panel comprises a first corner panel portion and a main panel portion, the first corner panel portion being hingedly connected to the first primary panel by the first hinged connection and to the main panel portion by a first corner hinged connection wherein the first hinged connection is greater in fold resistance than the first corner hinged connection.

Optionally, the second primary panel further comprises a second corner panel portion, the second corner panel portion being hingedly connected to the third primary panel by the second hinged connection and to the main panel portion by a second corner hinged connection wherein the second corner hinged connection is greater in fold resistance than the second hinged connection.

Optionally, the first corner hinged connection is substantially equal in fold resistance to the second hinged connection.

Optionally, the fourth primary panel comprises an additional corner panel portion and a second main panel portion, the additional corner panel portion being hingedly connected to the third primary panel by the third hinged connection and to the second main panel portion by an additional corner hinged connection wherein the third hinged connection is greater in fold resistance than the additional corner hinged connection.

Optionally, the fourth primary panel comprises a further corner panel portion and a second main panel portion, the further corner panel portion being hingedly connected to the first primary panel by the fourth hinged connection and to the second main panel portion by a further corner hinged connection wherein the further corner hinged connection is greater in fold resistance than the fourth hinged connection.

Optionally, the second primary panel further comprises a corner panel portion, the corner panel portion being hingedly connected to the third primary panel by the second hinged connection and to the main panel portion by a corner hinged connection wherein the corner hinged connection is greater in fold resistance than the second hinged connection.

Optionally, the corner hinged connection is substantially equal in fold resistance to the first hinged connection.

Optionally, the carrier further comprises a partition structure for dividing the interior of the carton into two or more compartments, the partition structure including a primary divider panel hingedly connected to both the first and third primary panels such that tubular structure may be collapsed with the primary divider panel being in a face contacting arrangement with the inside surfaces of the second and fourth primary panels, the primary divider panel being hingedly connected to the first primary panel by a fifth hinged connection and to the third primary panel by a sixth hinged connection, and wherein the fifth hinged connection is greater in fold resistance that the sixth hinged connection.

A second aspect of the invention provides a carrier comprising a collapsible tubular structure which comprises a first primary panel, a second primary panel, a third primary panel and a fourth primary panel wherein the first and second primary panels are hingedly connected by a first hinged connection, the second and third primary panels are hingedly connected by a second hinged connection, the third and fourth primary panels are hingedly connected by a third hinged connection, the fourth and first primary panels are hingedly connected by a fourth hinged connection, and wherein the first hinged connection is less in fold resistance than the second hinged connection and substantially equal in fold strength to the fourth hinged connections.

Optionally, the third hinged connection is greater in fold resistance than the fourth hinged connections and substantially equal in fold strength to the second hinged connection.

Optionally, the first hinged connection is less in fold resistance than the third hinged connection.

Optionally, the second hinged connection is greater in fold resistance to the fourth hinged connection.

Optionally, the second primary panel comprises a first corner panel portion and a main panel portion, the first corner panel portion being hingedly connected to the first primary panel by the first hinged connection and to the main panel portion by a first corner hinged connection wherein the first hinged connection is lower in fold resistance than the first corner hinged connection.

Optionally, the second primary panel further comprises a second corner panel portion, the second corner panel portion being hingedly connected to the third primary panel by the second hinged connection and to the main panel portion by a second corner hinged connection wherein the second corner hinged connection is lower in fold resistance than the second hinged connection.

Optionally, the first corner hinged connection is substantially equal in fold resistance to the second hinged connection.

Optionally, the fourth primary panel comprises an additional corner panel portion and a second main panel portion, the additional corner panel portion being hingedly connected to the third primary panel by the third hinged connection and to the second main panel portion by an additional corner hinged connection wherein the third hinged connection is greater in fold resistance than the additional corner hinged connection.

Optionally, the fourth primary panel comprises an additional corner panel portion and a second main panel portion, the additional corner panel portion being hingedly connected to the first primary panel by the fourth hinged connection and to the second main panel portion by an additional corner hinged connection wherein the additional corner hinged connection is greater in fold resistance than the fourth hinged connection.

Optionally, the second primary panel comprises a first corner panel portion and a main panel portion, the first corner panel portion being hingedly connected to the third primary panel by the second hinged connection and to the main panel portion by a first corner hinged connection wherein the first corner hinged connection is lower in fold resistance than the second hinged connection.

Optionally, the first corner hinged connection is substantially equal in fold resistance to the first hinged connection.

Optionally, the carrier further comprises a partition structure for dividing the interior of the carton into two or more compartments, the partition structure including a primary partition panels hingedly connected to both the first and third primary panels such that tubular structure may be collapsed with the partition panels being in a face contacting arrangement with the inside surfaces of the second and fourth primary panels, the primary partition panels being hingedly connected to the first primary panel by a fifth hinged connection and to the third primary panel by a sixth hinged connection, and wherein the fifth hinged connection is greater in fold resistance that the sixth hinged connection.

A third aspect of the invention provides a carrier comprising a collapsible tubular structure which comprises a first primary panel, a second primary panel, a third primary panel and a fourth primary panel wherein the first and second primary panels are hingedly connected by a first hinged connection, the second and third primary panels are hingedly connected by a second hinged connection, the third and fourth primary panels are hingedly connected by a third hinged connection, the fourth and first primary panels are hingedly connected by a fourth hinged connection wherein the second primary panel comprises a first corner panel portion and a main panel portion, the first corner panel portion being hingedly connected to the first primary panel by the first hinged connection and to the main panel portion by a first corner hinged connection and wherein the first hinged connection is higher or lower in fold resistance than the first corner hinged connection.

Optionally, the first hinged connection comprises a working fold line and wherein the first hinged connection is greater in fold resistance than the first corner hinged connection.

Optionally, the first hinged connection comprises a non-working fold line and wherein the first hinged connection is lower in fold resistance than the first corner hinged connection.

A fourth aspect of the invention provides blank for forming an article carrier, the blank comprising a plurality of primary panels for forming walls of a tubular structure defining an interior chamber, the plurality of primary panels including: a first primary panel, a second primary panel, a third primary panel and a fourth primary panel wherein the first and second primary panels are hingedly connected by a first hinged connection, the second and third primary panels are hingedly connected by a second hinged connection, the third and fourth primary panels are hingedly connected by a third hinged connection, the fourth and first primary panels are hingedly connected by a fourth hinged connection, and wherein the first hinged connection is greater in fold resistance than each of the second and fourth hinged connections.

A fifth aspect of the invention provides a blank for forming an article carrier, the blank comprising a plurality of primary panels for forming walls of a tubular structure which comprises a first primary panel, a second primary panel, a third primary panel and a fourth primary panel wherein the first and second primary panels are hingedly connected by a first hinged connection, the second and third primary panels are hingedly connected by a second hinged connection, the third and fourth primary panels are hingedly connected by a third hinged connection, the fourth and first primary panels are hingedly connected by a fourth hinged connection, and wherein the first hinged connection is less in fold resistance than the second hinged connection and substantially equal in fold strength to the fourth hinged connections.

A sixth aspect of the invention provides a blank for forming an article carrier, the blank comprising a plurality of primary panels for forming walls of a tubular structure which comprises a first primary panel, a second primary panel, a third primary panel and a fourth primary panel wherein the first and second primary panels are hingedly connected by a first hinged connection, the second and third primary panels are hingedly connected by a second hinged connection, the third and fourth primary panels are hingedly connected by a third hinged connection, the fourth and first primary panels are hingedly connected by a fourth hinged connection wherein the second primary panel comprises a first corner panel portion and a main panel portion, the first corner panel portion being hingedly connected to the first primary panel by the first hinged connection and to the main panel portion by a first corner hinged connection and wherein the first hinged connection is greater or less in fold resistance than the first corner hinged connection.

Further features and advantages of the present invention will be apparent from the specific embodiments illustrated in the drawings and discussed below.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
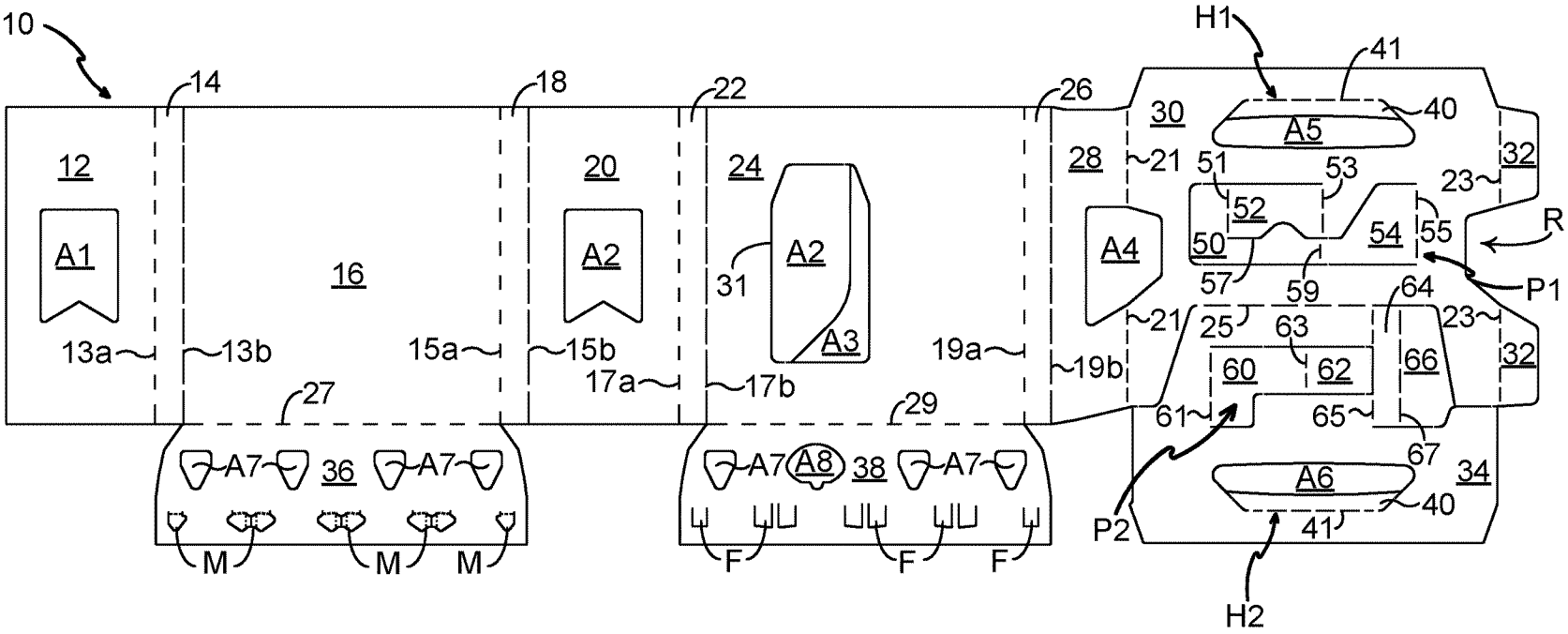
FIG. 1 is a plan view from above of a blank for forming a carrier according to a first embodiment.
Figure 7:
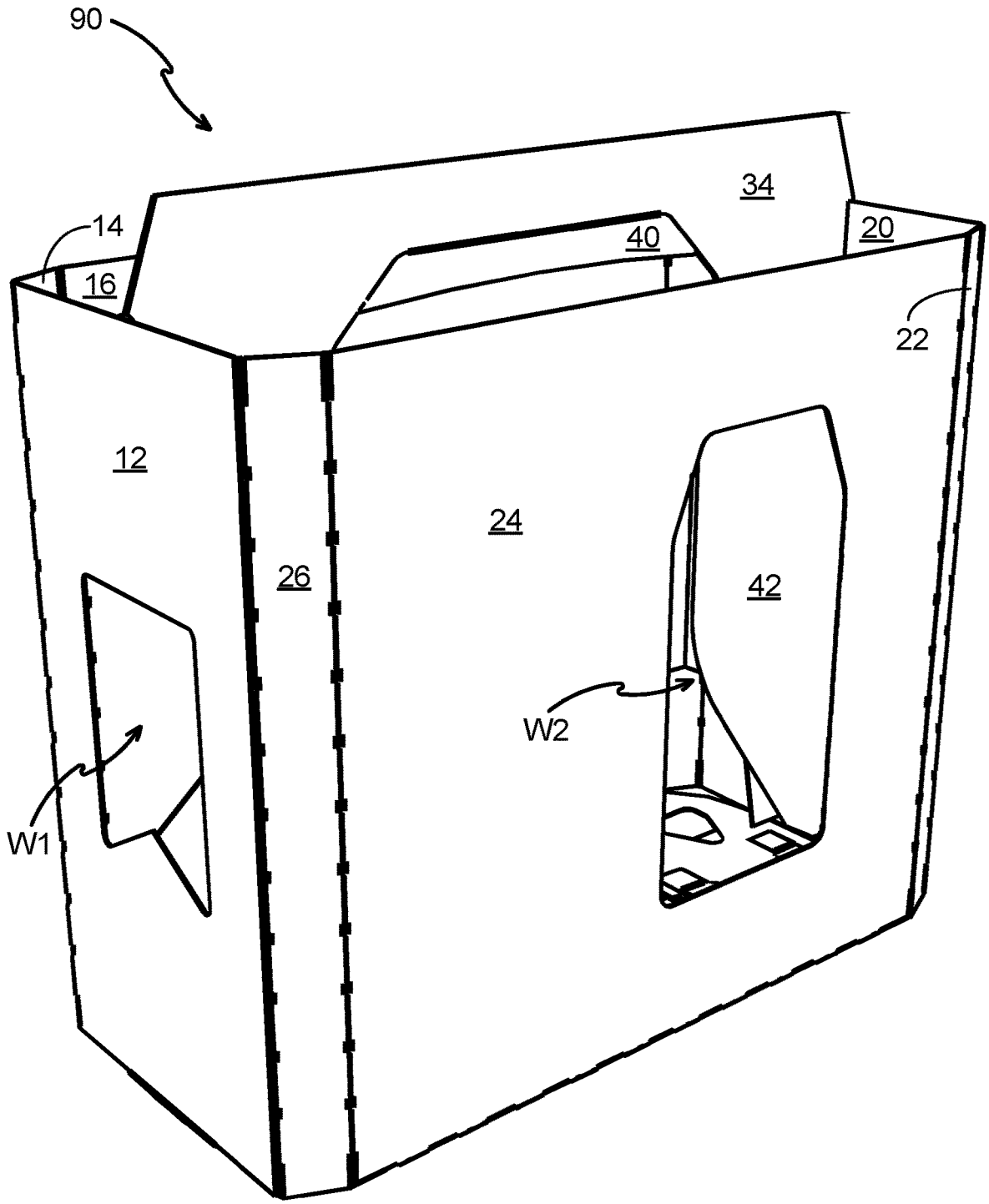
FIGS. 7 and 8 are perspective views from above of an article carrier formed from the blank of FIG. 1.
Figure 8:
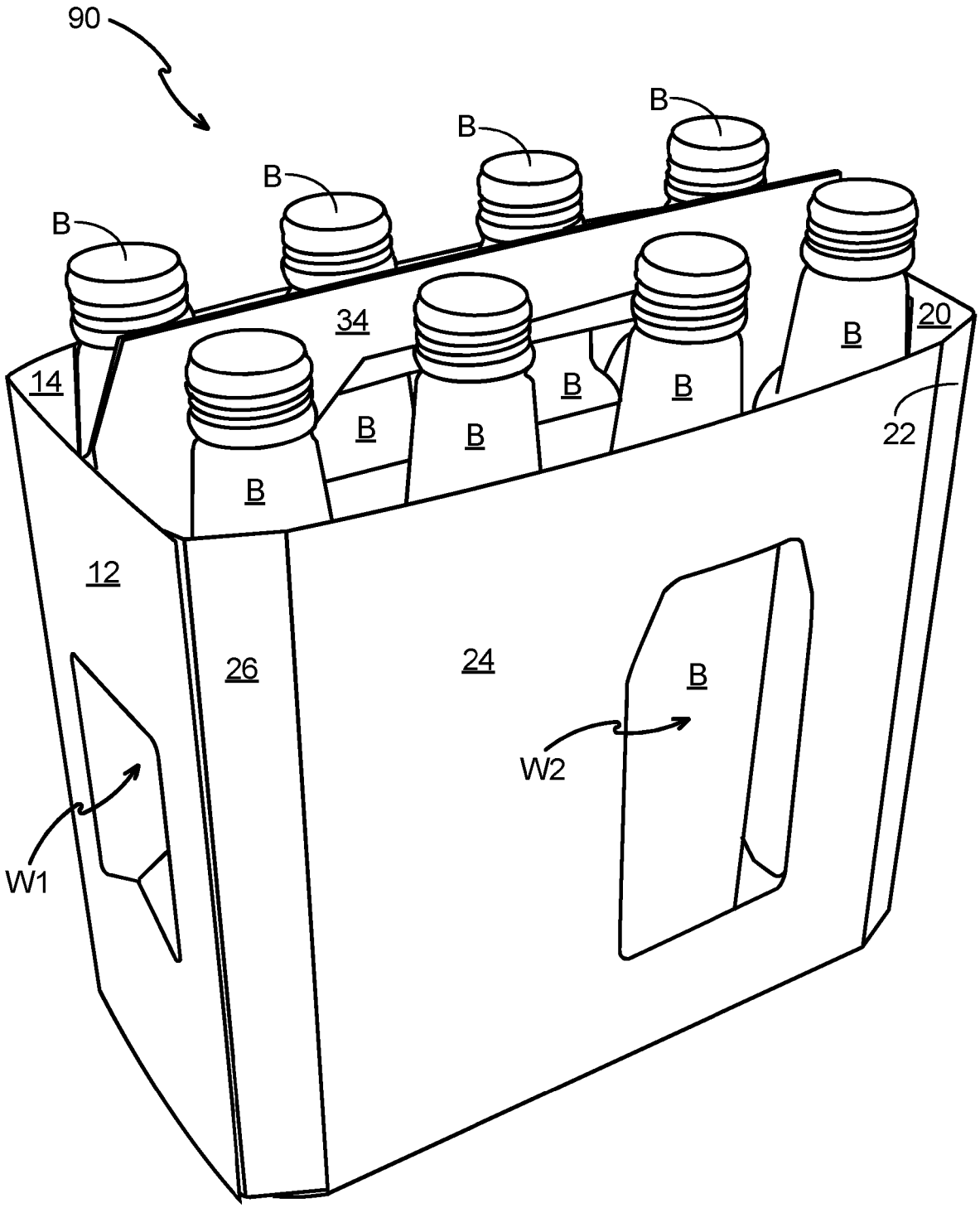

Referring to FIG. 1, there is shown a plan view of a blank 10 capable of forming a carton or carrier 90, as shown in FIGS. 7 and 8, for containing and carrying a group of primary products such as, but not limited to, bottles, hereinafter referred to as articles B. FIGS. 9 to 16, illustrate alternative blanks 110; 210 capable of forming a carton or carrier 190, for containing and carrying a group of primary products such as, but not limited to, bottles, hereinafter referred to as articles B. The blanks 10; 110; 210 each form a secondary package of the basket-carrier style for packaging at least one primary product container or package.

In the embodiments detailed herein, the terms "carton" and "carrier" refer, for the non-limiting purpose of illustrating the various features of the invention, to a container 90; 190 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blanks 10; 110; 210 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90; 190 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the embodiment of FIGS. 1 to 8, the blank 10 is configured to form a carton or carrier 90 for packaging an exemplary arrangement of exemplary articles B. In the embodiment of FIGS. 1 to 8 the arrangement is an m×n matrix or array, having two rows (m=2) and four columns (n=4). The embodiment comprises two rows of four articles B, and the articles B are 16 fl. oz. (473 ml) bottles, the bottle may be formed from a suitable material such as, but not limited to, glass, Aluminium or PET (polyester-polyethylene terephthalate). In the embodiments of FIGS. 9 to 16 the arrangement is an m×n matrix or array, having two rows (m=2) and three columns (n=3). The embodiment comprises two rows of three articles B, and the articles B are 16 fl. oz. (473 ml) bottles, the bottle may be formed from a suitable material such as, but not limited to, glass, Aluminium or PET (polyester-polyethylene terephthalate). Alternatively, the blanks 10; 110; 210 can be configured to form a carrier for packaging other types, number and size of articles B and/or for packaging articles B in a different arrangement or configuration for example, but not limited to, fully enclosed cartons or wrap-around carriers, the articles B may be cups, pouches, pots or cans.

Turning to FIG. 1, there is illustrated a blank 10 for forming a carton or carrier 90 (see FIG. 7) according to a first embodiment. The blank 10 comprises a plurality of panels 12, 14, 16, 18, 20, 22, 24, 26, 28 for forming a tubular structure. The plurality of panels 12, 14, 16, 18, 20, 22, 24, 26, 28 comprises a first outer end panel 12 (or outer layer), a first bevel or corner panel 14 (also referred to herein as a first corner panel portion), a first side panel 16, a second bevel or corner panel 18 (also referred to herein as a second corner panel portion), a second end panel 20, a third bevel or corner panel 22 (also referred to herein as a third corner panel portion), a second side panel 24, a fourth bevel or corner panel 26 (also referred to herein as a fourth corner panel portion), and a first inner end panel or securing panel (or inner layer) 28. The plurality of panels 12, 14, 16, 18, 20, 22, 24, 26, 28 may be arranged in a linear series hinged one to the next by corresponding fold lines 13*a*, 13*b*, 15*a*, 15*b*, 17*a*, 17*b*, 19*a*, 19*b*.

The first outer end panel 12 and the first inner end panel 28 form a first primary panel 12/28 of the tubular structure.

The first corner panel 14, the first side panel 16 and the second corner panel 18 form a second primary panel 14/16/18 of the tubular structure. The first corner panel 14 forms a first corner panel portion 14 of the second primary panel 14/16/18. The second corner panel 18 forms a second corner panel portion 18 of the second primary panel 14/16/18. The first side panel 16 forms a main panel 16 of the second primary panel 14/16/18. The first corner panel 14 is hinged to the main panel 16 of the second primary panel 14/16/18 by a first corner hinged connection, in the form of a fold line 13*b*. The second corner panel 18 is hinged to the main panel 16 of the second primary panel 14/16/18 by a second corner hinged connection, in the form of a fold line 15*a*.

The second end panel 20 forms a third primary panel 20 of the tubular structure.

The third corner panel 22, the second side panel 24 and the fourth corner panel 26 form a fourth primary panel 22/24/26 of the tubular structure. The third corner panel 22 forms a third corner panel portion 22 of the fourth primary panel 22/24/26. The fourth corner panel 26 forms a fourth corner panel portion 26 of the fourth primary panel 22/24/26. The second side panel 24 forms a main panel 24 of the fourth primary panel 22/24/26. The third corner panel 22 is hinged to the main panel 24 of the fourth primary panel 22/24/26 by a third corner hinged connection, in the form of a fold line 17*b*. The fourth corner panel 26 is hinged to the main panel 24 of the fourth primary panel 22/24/26 by a fourth corner hinged connection, in the form of a fold line 19*a*.

The first primary panel 12/28 is hinged to the second primary panel 14/16/18 by a first hinged connection, in the form of a first fold line 13*a*.

The second primary panel 14/16/18 is hinged to the third primary panel 20 by a second hinged connection, in the form of a second fold line 15*b*.

The third primary panel 20 is hinged to the fourth primary panel 22/24/26 by a third hinged connection, in the form of a third fold line 17*a*.

The first primary panel 12/28 is hinged to the fourth primary panel 22/24/26 by a fourth hinged connection, in the form of a fourth fold line 19*b*, since the first inner end panel 28 is secured to the first outer end panel 12*b*.

The blank 10 comprises a first base panel 36 hinged to the first side panel 16 by a hinged connection in the form of a fold line 27. The blank 10 comprises a second base panel 38 hinged to the second side panel 24 by a hinged connection in the form of a fold line 29.

The first and second base panels 36, 38 are engageable with one another in an overlapping relationship to form a composite base wall 36/38 of the carrier 90. The blank 10 may comprise a complementary locking mechanism for securing the first base panel 36 to the second base panel 38. The first base panel 36 may comprise at least one first part M of the complementary locking mechanism. The second base panel 38 may comprise at least one second part F of the complementary locking mechanism. In the illustrated embodiment, the first base panel 36 comprises five male tabs M struck therefrom so as to be defined within the first base panel 36. Each of the male tabs M is hingedly connected to the first base panel 36 by a hinged connection in the form of a fold line.

The second part F of the complementary locking mechanism forms a receiver. The receiver comprises an opening or slot for receiving the male tab M.

The second base panel 38 comprises five optional female tabs each defining an opening or slot in the second base panel 38; the female tabs forming at least part of the receiver.

The openings in the second base panel 38 are configured to receive respective ones of the male tabs M.

The female tabs are arranged to be displaced out of the second base panel 38 to form said openings and to bear against the respective male tab M when received therein. In some embodiments the complementary locking mechanism M/F may be omitted, the first and second base panels 36, 38 may be secured to each other by other means, such as but not limited to adhesive or staples.

Optionally, the first and second base panels 36, 38 may comprise at least one first aperture A7. In the illustrated embodiment, the first base panel 36 comprises four first apertures A1 and the second base panel 38 comprises three first apertures A7. The second base panel 38 comprises at least one second aperture A8, in the illustrated embodiment, the second base panel 38 comprises one second apertures A8. The first and second apertures A7, A8 may be employed to facilitate construction of the carrier 90. A packaging machine component or tool may engage with the first and second apertures A7, A8 to facilitate alignment of the first and second base panels 36, 38 with respect to each other or to align the first part M of the complementary locking mechanism with the second part F of the complementary locking mechanism. The complementary locking mechanism illustrated and described is entirely optional.

A first portion of the second aperture A8 is adapted to facilitate alignment of the first and second base panels 36, 38 with respect to each other.

The second aperture A8 comprises a second portion which forms an orientation adjustment device for enabling the orientation of an article B, a tool may be inserted or received in the second aperture A8 so as to engage an article B disposed thereabove.

The blank 10 optionally comprises a first display window aperture A1 for forming a first display window W1 (see FIG. 7). The first display window aperture A1 is struck from the first end panel 12. The blank 10 optionally comprises a second display window aperture A4 for forming the first display window W1. At least a portion of the second display window aperture A4 is arranged to be disposed in registry with the first display window aperture A1 so as to define an opening, first display window W1, in the first primary panel 12/28 of the article carrier 90.

In a set up carrier the first display window W1 exposes to view portions of endmost articles B in each row of articles B which are disposed adjacent to the first display window W1.

The blank 10 optionally comprises a second display window aperture A3 for forming a second display window W2 (see FIG. 7). The second display window W2 comprises a second opening defined in, or struck from the third primary panel 22/24/26 for example, but not limited to the second side panel 24. The second opening may be defined in part by the second display window aperture A3 and in part by a tab 42 struck from the second side panel 24 and hingedly connected thereto by a hinged connection in the form of a fold line 31. The tab 42 forms part of an optional partition structure described in more detail below.

The blank 10 optionally comprises a third display window aperture A2 for forming a third display window. The third display window aperture A2 is struck from the second primary panel 20 or second end panel 20. In a set up carrier the third display window exposes to view portions of endmost articles B in each row of articles B which are disposed adjacent to the third display window.

The blank 10 comprises a divider or medial structure including a first medial panel 30 (also referred to herein as primary divider panel) and a second medial panel 34 (also referred to herein as secondary divider panel).

The first medial panel 30 is hingedly connected at a first end to the first inner end panel 28 by a hinged connection in the form of a fold line 21.

The second medial panel 34 is hingedly connected to the first medial panel 30 along a lower edge thereof by a hinged connection in the form of a fold line 25.

The first and second medial panels 30, 34 form a divider extending longitudinally between the first inner and outer end panels 12, 28 and the second end panel 20.

The first medial panel 30 provides a first handle structure H1. The second medial panel 34 provides a second handle structure H2. Together the first and second medial panels 30, 34 provide a two ply handle structure, the second ply reinforcing the first ply.

The first handle structure H1 comprises a first handle opening.

The first handle opening may be defined in part by a first handle aperture A5 struck from an upper portion of the first medial panel 30.

The first handle structure H1 may comprise an optional first cushioning flap 40 struck from the first medial panel 30 and hinged thereto by a hinged connection in the form of a fold line 41.

The first cushioning flap 40 defines at least a part of the first handle opening.

The second handle structure H2 is substantially similar in construction to the first handle structure H1.

The second handle opening is arranged to be disposed in registry or alignment with the first handle opening.

The blank 10 comprises a pair of medial partition glue flaps 32 hingedly connected to the first medial panel 30 along a second end (the second end opposes the first end, the first end is defined by fold line 21) by a hinged connection in the form of a fold line 23. The pair of medial partition glue flaps 32 may be spaced apart from each other or interrupted by a cutaway or recess R struck from the second end of the first medial panel 30. The recess R is arranged such that the pair of medial partition glue flaps 32 and first medial panel 30 do not obstruct or close the third display window in the second end panel 20.

The blank 10 may comprise a first partition structure P1. The first partition structure P1 defines or creates a plurality of cells disposed between the first side panel 16 and the first medial panel 30. The first side panel 16 and the first medial panel 30 along with portions of the first and second end panels 12/28, 20 define a tubular structure or first compartment on a first side of the medial structure.

The first compartment provides an interior for receiving at least a lower portion of one or more articles B.

The first partition structure P1 comprises a first partition panel 54 struck from the first medial panel 30 and hingedly connected, at a first or proximal end, thereto by a hinged connection in the form of a fold line 55.

The first partition structure P1 comprises a second partition panel 52 struck from the first medial panel 30 and hingedly connected, at first or a proximal end, thereto by a hinged connection in the form of a fold line 53.

The first partition structure P1 comprises a first glue panel 50 to which the first and second partition panels 54, 52 are each coupled by distal end joints.

The first partition panel 54 is hingedly connected, at a second or distal end, to a first end of the first glue panel 50 by a hinged connection in the form of fold line 59. Fold line 59 defines an outer end of the first partition panel 54, fold line 55 defines an inner end of the first partition panel 54, and a linear dimension is defined therebetween.

Fold line 59 may be collinear with fold line 53 in the blank 10.

The second partition panel 52 is hingedly connected, at a second or distal end, to a second end of the first glue panel 50 (the second end opposes the first end) by a hinged connection in the form of fold line 51. Fold line 51 defines an outer end of the second partition panel 52, fold line 53 defines an inner end of the second partition panel 52, and a linear dimension is defined therebetween.

The second partition panel 52 is separated from the first glue panel 50 along or by a cut line or severance line. The second partition panel 52 may be severably coupled to the first glue panel 50 by one or more connecting portions or nicks N which interrupt the cut line or severance line.

Optionally, the blank 10 comprises a second partition structure P2. The second partition structure P2 defines a plurality of cells disposed between the second side panel 24 and the second medial panel 34. The second side panel 24 and the second medial panel 34 along with portions of the first and second end panels 12/28, 20 define a second tubular structure or compartment on a second side of the medial structure.

The second compartment provides an interior chamber for accommodating at least a lower portion of one or more articles B.

The second partition structure P2 comprises a third partition panel 60 struck from the second medial panel 34 and hingedly connected, at a first or proximal end, thereto by a hinged connection in the form of a fold line 61.

The second partition structure P2 comprises a second glue panel 62 to which the third partition panel 60 is coupled. The second glue panel 62 is hingedly connected to the third partition panel 60 by a hinged connection in the form of a fold line 63. Fold line 63 defines a distal end of the fourth partition panel 60 and the fold line 61 defines a proximal end of the third partition panel 60.

The second partition structure P2 comprises a fourth partition panel 64/66 struck from the second medial panel 34 and hingedly connected, at first or a proximal end, thereto by a hinged connection in the form of a fold line 65.

The fourth partition panel 64/66 comprises a first part 64 and a second part 66, the second part in hingedly connected to the first part by a fold line 67.

The second part 66 is arranged to be secured to the tab 42 provided in the second side panel 24.

The second part 66 and the tab 42, in an erected carrier, extend substantially perpendicularly to the second side panel 24. The first part 64 may be divergently arranged with respect to the second part 66 and the tab 42 and with respect to the medial partition structure.

In this way the fourth partition panel 64/66 and tab 42 combine to form a partition extending between second side panel 24 and the second medial panel 34.

Figure 2:
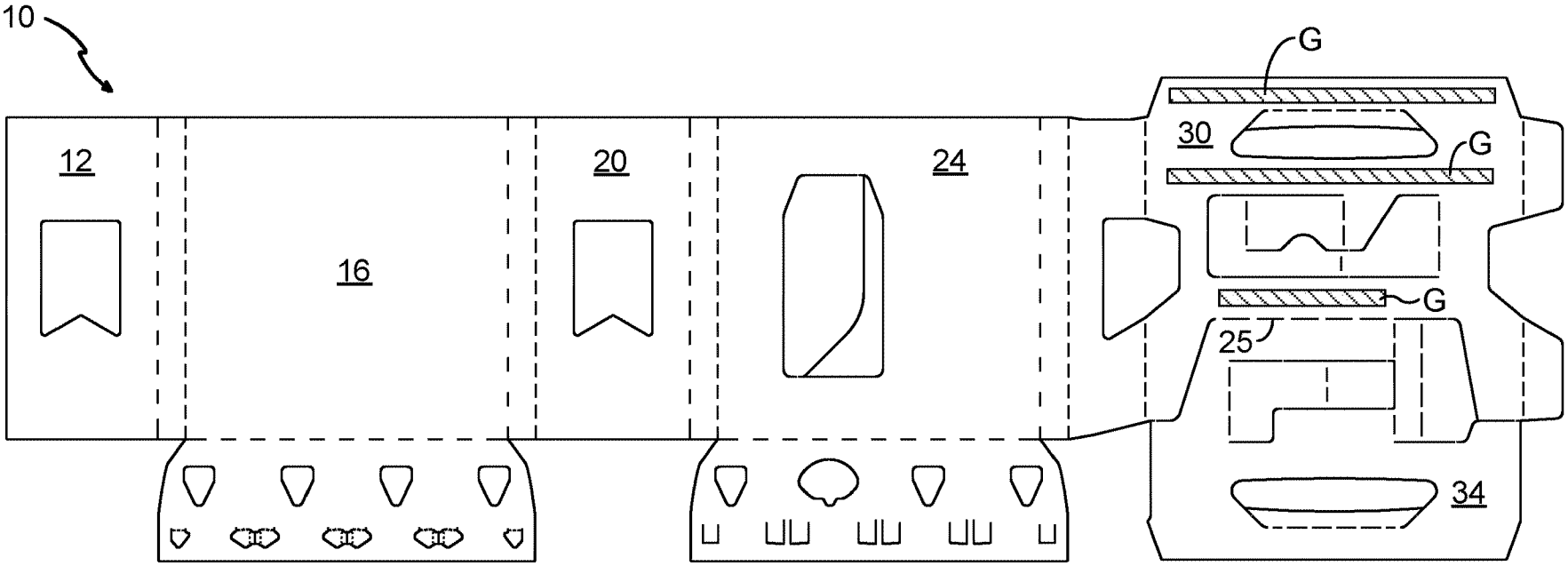
FIGS. 2 to 6 illustrate stages of construction of the blank of FIG. 1 into a flat collapsed carrier.

The blank 10 is foldable to form a package 90 as illustrated in FIG. 2.

Turning to the construction of the carrier 90 as illustrated in FIG. 2, the carrier 90 can be formed by a series of sequential folding operations in a straight-line machine so that the carrier 90 is not required to be rotated or inverted to complete its construction. The folding process is not limited to that described below and may be altered according to particular manufacturing requirements.

Glue or other adhesive treatment is applied to one or both of the first and second medial panels 30, 34 as shown in FIG. 2.

Figure 3:
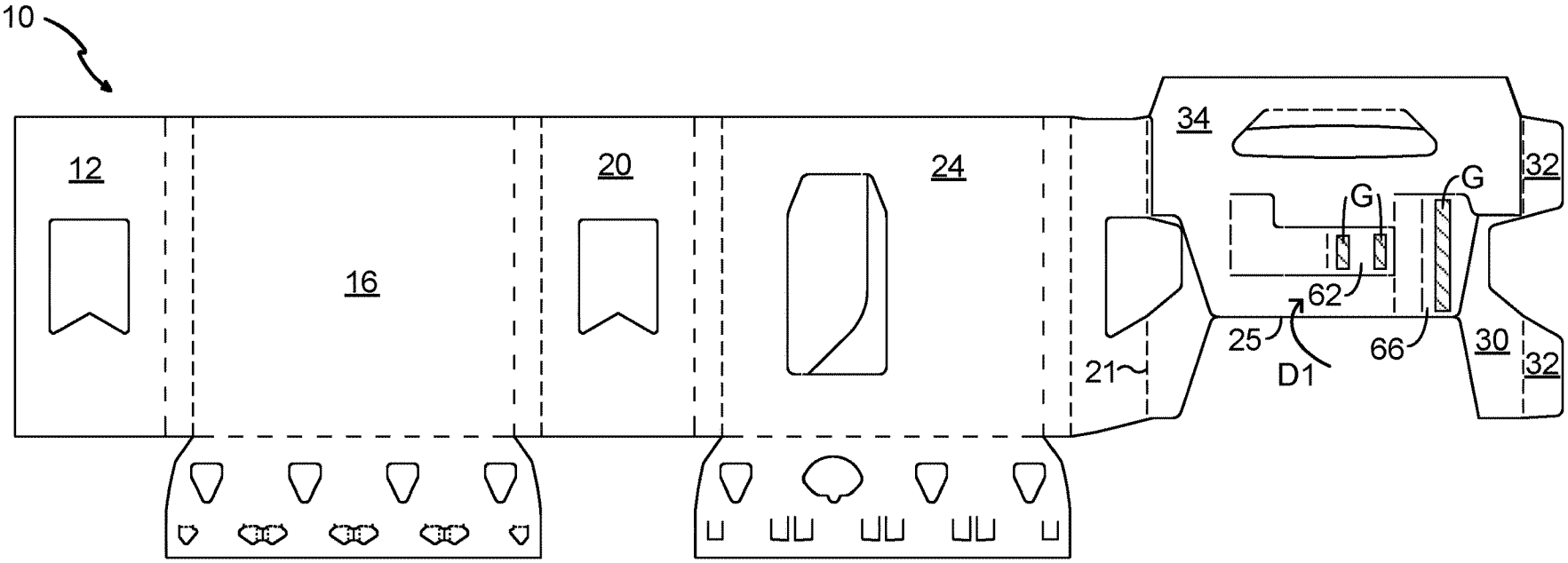

The second medial panel 34 is folded, with respect to the first medial panel 30 about fold line 25, as indicated by direction arrow D1 shown in FIG. 3. The second medial panel 34 is secured to the first medial panel 30 in face contacting relationship therewith.

Glue or other adhesive treatment is applied to the second glue panel 62 and to the second part 66 of the fourth partition panel 64/66. Alternatively, glue or other adhesive treatment may be applied to a corresponding region of the second side panel 24.

Figure 4:
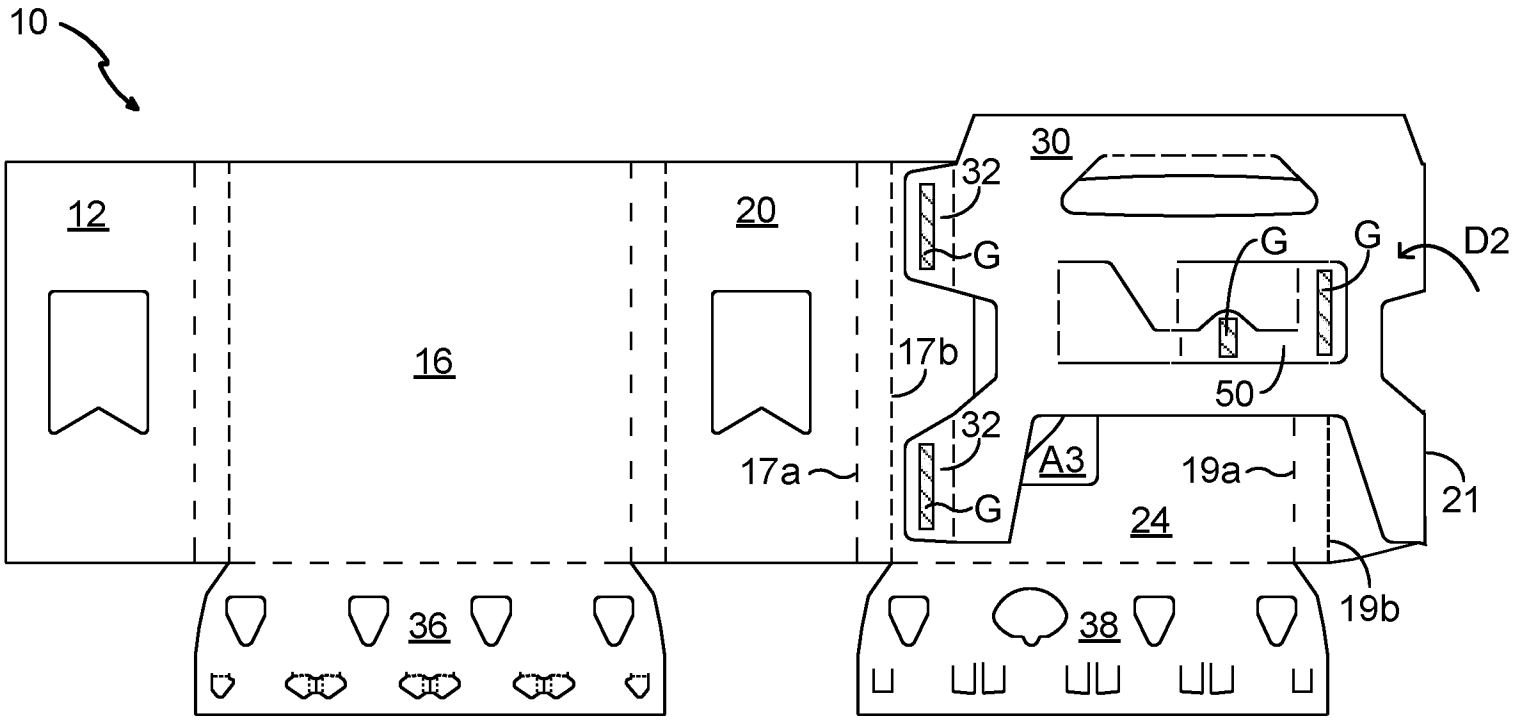

The first medial panel 30 (and consequently the second medial panel 34) is folded, with respect to the first inner end panel 28 about fold line 21, as indicated by direction arrow D2 shown in FIG. 4. The second medial panel 34 is brought into face to face relationship with the second side panel 24 and the first inner end panel 28. The second glue panel 62 is secured to the second side panel 24 in face contacting relationship therewith. The second part 66 of the fourth partition panel 64/66 is secured to the tab 42 in face contacting relationship therewith.

Glue or other adhesive treatment is applied to the first glue panel 50. Alternatively, glue or other adhesive treatment may be applied to a corresponding region of the first side panel 16.

Glue or other adhesive treatment is applied to the pair of medial partition glue flaps 32. Alternatively, glue or other adhesive treatment may be applied to a corresponding region of the second end panel 20.

Figure 5:
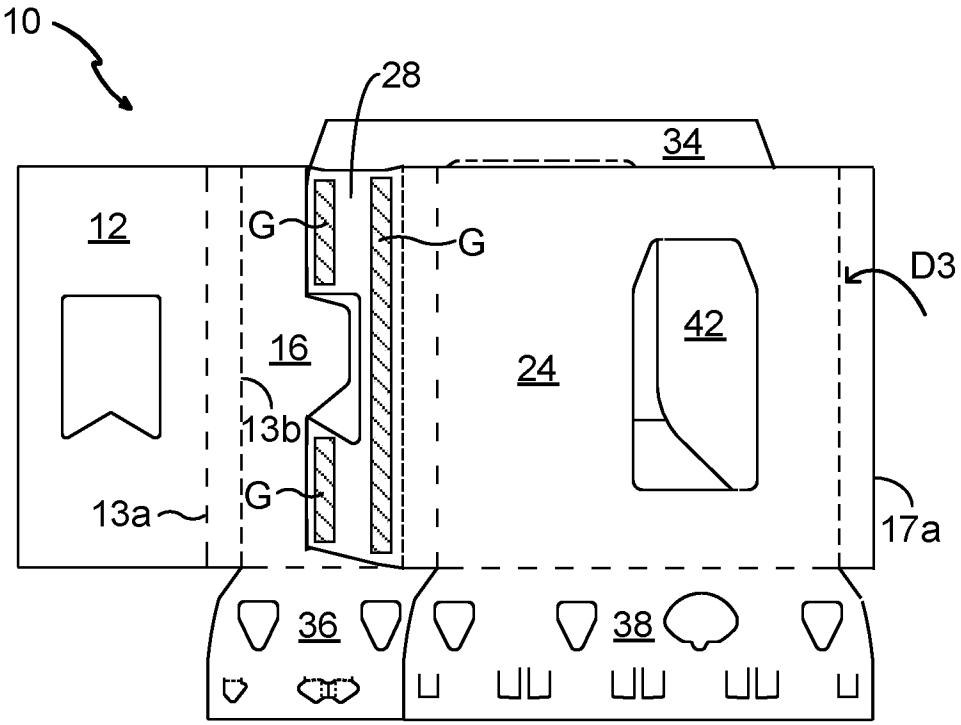

The second side panel 24, together with the first and second medial panel 30, 34 and second part 66 of the fourth partition panel 64/66, is folded about the fold line 17*a* to bring the first medial panel 30 into face to face relationship with the second end panel 20 and the first side panel 16, as indicated by direction arrow D3 in FIG. 5.

The medial partition glue flap 32 is secured to the second end panel 20.

The first glue panel 50 is secured to the first side panel 16.

Glue or other adhesive treatment is applied to the first inner end panel 28. Alternatively, glue or other adhesive treatment may be applied to a corresponding region of the first outer end panel 12.

Figure 6:
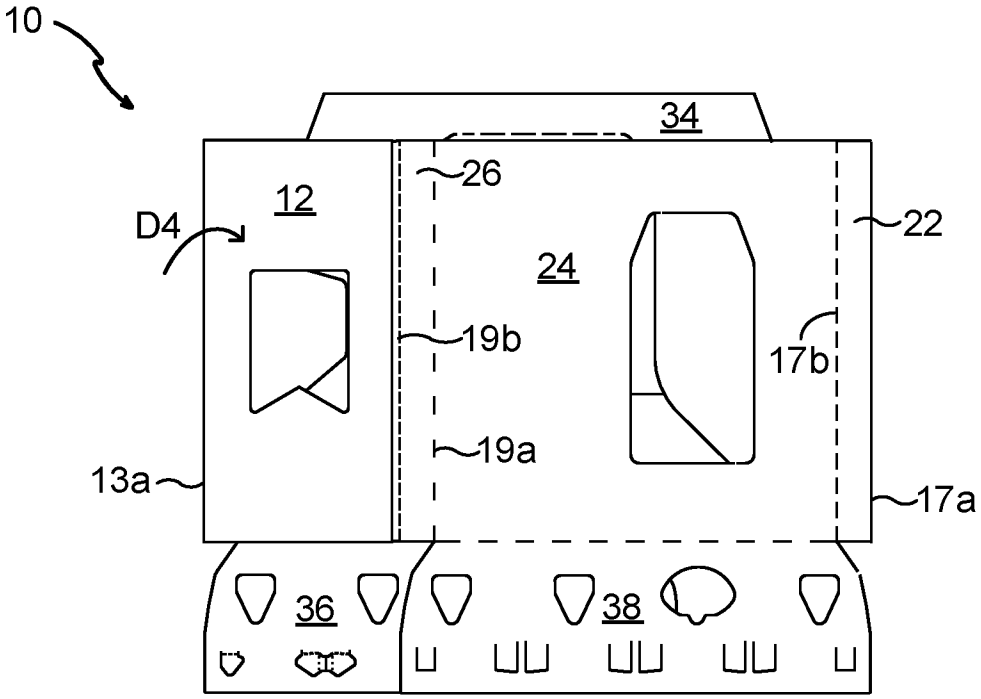

The first outer end panel 12 is folded about the fold line 13 as indicated by direction arrow D4 in FIG. 6 so as to be disposed in face to face relationship with the first inner end panel 28.

The first outer end panel 12 is secured to the first inner end panel 28. In this way a flat collapsed tubular structure is formed.

A flat collapsed carrier is thereby formed, as shown in FIG. 6, the flat collapsed carrier can be readily shipped or distributed in the flat condition to a plant for erecting and loading with primary product containers.

The flat collapsed carrier can be opened into a basket-style article carrier by separating the first and second side panels 16, 24 to form a tubular structure defined by the first primary panel 12/28, second primary panel 14/16/18, third primary panel 20 and fourth primary panel 22/24/26. The primary panels 12/28, 14/16/18, 20, 22/24/26 define an interior chamber. The partition structures P1, P2 are automatically erected when the flat collapsed carrier is opened out or erected into the tubular form.

The fold line 13*a* has a different folding resistance to the fold line 13*b*. In particular the fold line 13*b* has a greater or higher fold resistance than the fold line 13*a*. The fold lines 15*a*, 15*b*, 17*a*, 17*b* and 19*a*, 19*b* are similarly arranged. It will be appreciated that the substrate material requires a given amount of force to be folded. The provision of fold lines in the substrate define location at which the substrate is to be folded. These fold lines may alter or reduce the material's resistance to being folded. The extent or degree to which the material's resistance to being folded is reduced is dependent upon the structure of the fold line employed.

The fold resistance of a hinged connection or fold line may be a function of several factors. These factors may include, but not limited to;

- the length of the fold line,
- the type of the fold line elements used to form the fold line,
- the total length of fold line elements of a first type over that of fold line elements of a second type.

The hinged connection may be defined by (or comprise) one or more, or a combination of, fold line elements including: a full depth cut and crease line, a half depth cut and crease line, a score line, an embossed line, a perforation and a cutaway such as an aperture, slot, or recess. An embossed line or region may achieve by pressing the material in a die, such that a region is pressed inwardly, or outwardly, from one or both of the sides or faces of the substrate for example but not limited to the coated or printable side of a paperboard substrate. The embossed line may reduce the thickness of the substrate in the embossed (pressed) region or may offset the embossed (pressed) region with respect to adjacent regions of the substrate. The embossed region may be raised or depressed with respect to adjacent regions of the substrate.

The hinged connections may be created, in part, by forming a valley-like depression into the substrate on at least one side thereof.

In the illustrated embodiment, the fold lines 13*a*, 15*a*, 17*a*, 19*a* are formed by an alternating sequence of full depth cut lines and embossed lines. Each of the full depth cut lines comprises a first length and each of the embossed lines comprises a second length. The first length is substantially equal to the second length. In some embodiments, the first length may be about 9 mm or 10 mm. The opposed ends of the fold lines 13*a*, 15*a*, 17*a*, 19*a* each terminate with an embossed line, the length of the terminal embossed lines may be equal to, greater than or less than the first length.

In some embodiments the fold lines 13*a*, 17*a* may be different to the fold lines 15*a*, 19*a*, for example but not limited to fold lines 13*a*, 17*a* may have first length of about ⅜" (approx. 9.5 mm) and a second length of about ⅜" (approx. 9.5 mm), whereas the fold lines 15*a*, 19*a* may have first length of about ⅜" (approx. 9.5 mm) and a second length of about ½" (approx. 12.7 mm)

In the illustrated embodiment, the fold lines 13*b*, 15*b*, 17*b*, 19*b* are formed by an alternating sequence of full depth cut lines and embossed lines. Each of the full depth cut lines comprises a third length and each of the embossed lines comprises a fourth length. The third length is greater than the fourth length. The third length may be approximately three times greater than the fourth length. In some embodiments, the third length may be about 30 mm and the fourth length may be about 10 mm. The opposed ends of the fold lines 13*b*, 15*b*, 17*b*, 19*b* each terminate with an embossed line, the length of the terminal embossed lines may be equal to, greater than or less than the fourth length. The length of the terminal embossed lines may be less than the third length.

In some embodiments the full depth cut lines may be interrupted by a nick (small bridge of fibre) or frangible connecting portion.

In other embodiments, the third length may be about ½" (approx. 12.7 mm) and the fourth length may be about ⅛" (approx. 3.1 mm). The third length may be approximately four times greater than the fourth length.

Referring to FIG. 6, flat collapsed carrier the first hinged connection (first fold line 13*a*) between the first primary panel 12/28 and the second primary panel 14/16/18 forms a working crease or fold, that is to say that in the flat collapsed form shown in FIG. 6 the first hinged connection 13*a* is in a folded condition. Similarly, the third hinged connection (third fold line 17*a*) between the third primary panel 20 and the fourth primary panel 22/24/26 forms a working crease or fold.

The second hinged connection (second fold line 15*b*) between the second primary panel 14/16/18 and the third primary panel 20 is non-working crease or fold, that is to say that in the flat collapsed form shown in FIG. 6 the second hinged connection 15*b* is in a unfolded condition. Similarly, the fourth hinged connection (fourth fold line 19*b*) between the first primary panel 12/28 and the fourth primary panel 22/24/26 is non-working crease or fold.

The fold resistance of the first hinged connection 13*a* is greater than the fold resistance of second hinged connection 15*b*.

The fold resistance of the first hinged connection 13*a* is greater than the fold resistance of fourth hinged connection 19*b*.

The fold resistance of the third hinged connection 17*a* may be greater than the fold resistance of second hinged connection 15*b*.

The fold resistance of the third hinged connection 17*a* may be greater than the fold resistance of fourth hinged connection 19*b*.

The fold resistance of the second hinged connection 15*b* may be substantially equal to the fold resistance of fourth hinged connection 19*b*.

The fold resistance of the first hinged connection 13*a* may be substantially equal to the fold resistance of third hinged connection 17*a*.

The fold line 13*b* is located adjacent to the first hinged connection 13*a*. The first hinged connection 13*a* forms the working crease or fold. The fold line 13*b* has a lower folding resistance than the fold line 13*a* which forms the first hinged connection 13*a*.

The fold line 17*b* is located adjacent to the third hinged connection 17*a*. The third hinged connection 17*a* forms the working crease or fold. The fold line 17*b* has a lower folding resistance than the fold line 17*a* which forms the third hinged connection 17*a*.

The fold line 15*b* which forms a non-working crease has a lower folding resistance than the fold line 15*a*, in this way the carrier 90 is biased to fold at the fold line 15*b* in preference to the fold line 15*a*. The fold line 15*b* folds before the fold line 15*a* when the carrier 90 is erected form the flat collapsed state into an erected condition.

The fold line 19*b* which forms a non-working crease has a lower folding resistance than the fold line 19*a*, in this way the carrier 90 is biased to fold at the fold line 19*b* in preference to the fold line 19*a*. The fold line 19*b* folds before the fold line 19*a* when the carrier 90 is erected form the flat collapsed state into an erected condition.

The first and third hinged connections, fold lines 13*a*, 17*a* may be pre-folded either prior to or during the assembly of the blank 10 into the flat collapsed carrier.

Once the carrier 90 is erected, the first and second medial panels 30, 34 form a partition, that is disposed medially within the interior of the carrier 90 formed by the primary panels. The partition divides the interior of the carrier 90 into two separate compartments on opposing sides of the first and second medial panels 30, 34.

The first partition structure P1 is automatically erected to form a first plurality of cells in a first compartment disposed on a first side of the first and second medial panels 30, 34.

The second partition structure P2 is automatically erected to form a second plurality of cells in a second compartment disposed on a second side of the first and second medial panels 30, 34.

The carrier 90 may be loaded with a group of articles B; in the embodiment illustrated in FIG. 2 eight articles B are arranged in a 4×2 array.

The group of articles B may be loaded through a lower end of the tubular structure formed by the primary panels prior to folding the first and second base panel 36, 38. Alternatively, the group of articles B may be loaded through an upper end of the tubular structure subsequent to assembly of the composite base panel 36, 38.

When the carrier 90 is loaded with articles the fold lines 13*b*, 15*a*, 17*b* and 19*a* may be folded to form corner panels 14, 18, 22, 26. In this way the carrier 90 comprises chamfered or bevelled corners. The fold lines 15*a*, 19*a* that are disposed at non-working crease corners of the carrier 90 have a lower or lesser bend or fold resistance than the fold lines 13*b*, 17*b* that are disposed at working crease corners of the carrier 90.

The second base panel 38 is folded with respect to the second side panel 24 about fold line 29. The first base panel 36 is folded with respect to the first side panel 16 about fold line 27. The first base panel 36 is brought into face contacting relationship with the second base panel 38. The first base panel 36 is disposed in at least partial overlapping relationship with the second base panel 38.

Each of the first parts M of the complementary locking mechanism is aligned with a respective one of the second parts F of the complementary locking mechanism. The first parts M of the complementary locking mechanism are folded inwardly of the interior of the carrier such that they are received by the second parts F of the complementary locking mechanism, when the second parts F of the complementary locking mechanism comprises female tabs these are also folded inwardly and may bear against the first parts M of the complementary locking mechanism.

Referring now to FIGS. 9 to 13, there are shown alternative embodiments of the present invention. In the second, third, fourth and subsequent illustrated embodiments like numerals have, where possible, been used to denote like parts, albeit with the addition of the prefix "100"; "200"; "300" and so forth to indicate that these features belong to the second, third, fourth and subsequent embodiments respectively. The alternative embodiments share many common features with the first embodiment, and therefore only the differences from the embodiment illustrated in FIGS. 1 to 8 will be described in any greater detail.

Figure 9:
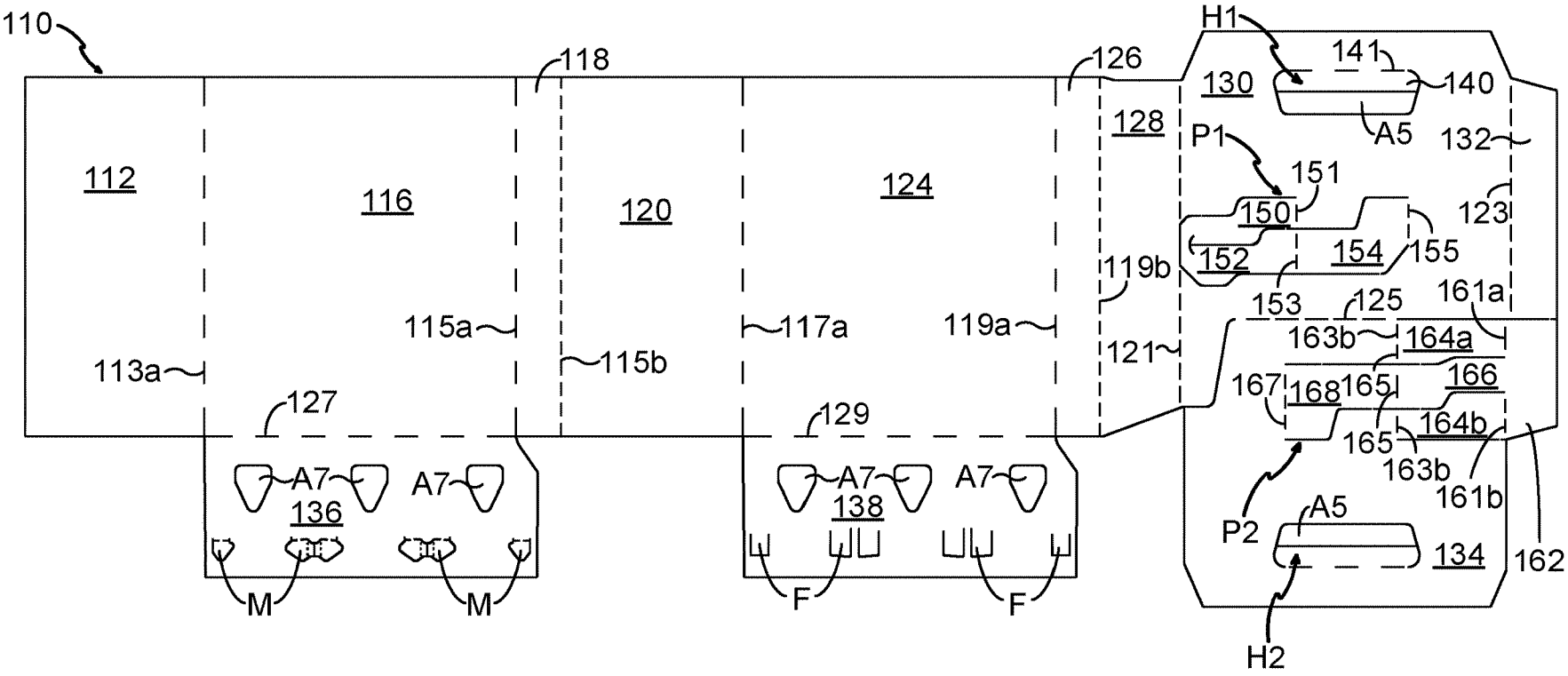
FIG. 9 is a plan view from above of a blank for forming a carrier according to a second embodiment.

In the embodiment of FIG. 9 a second embodiment is illustrated; a blank 110 for forming a carton or carrier 190 (see FIG. 10) comprises a plurality of panels 112, 116, 118, 122, 124, 126, 128 for forming a tubular structure. The plurality of panels 112, 116, 118, 122, 124, 126, 128 comprises a first outer end panel 112 (or outer layer), a first side panel 116, a second bevel or corner panel 118, a second end panel 120, a second side panel 124, a fourth bevel or corner panel 126, and a first inner end panel or securing panel (or inner layer) 128. The plurality of panels 112, 116, 118, 122, 124, 126, 128 may be arranged in a linear series hinged one to the next by corresponding fold lines 113*a*, 115*a*, 115*b*, 117*a*, 119*a*, 119*b*.

Figure 10:
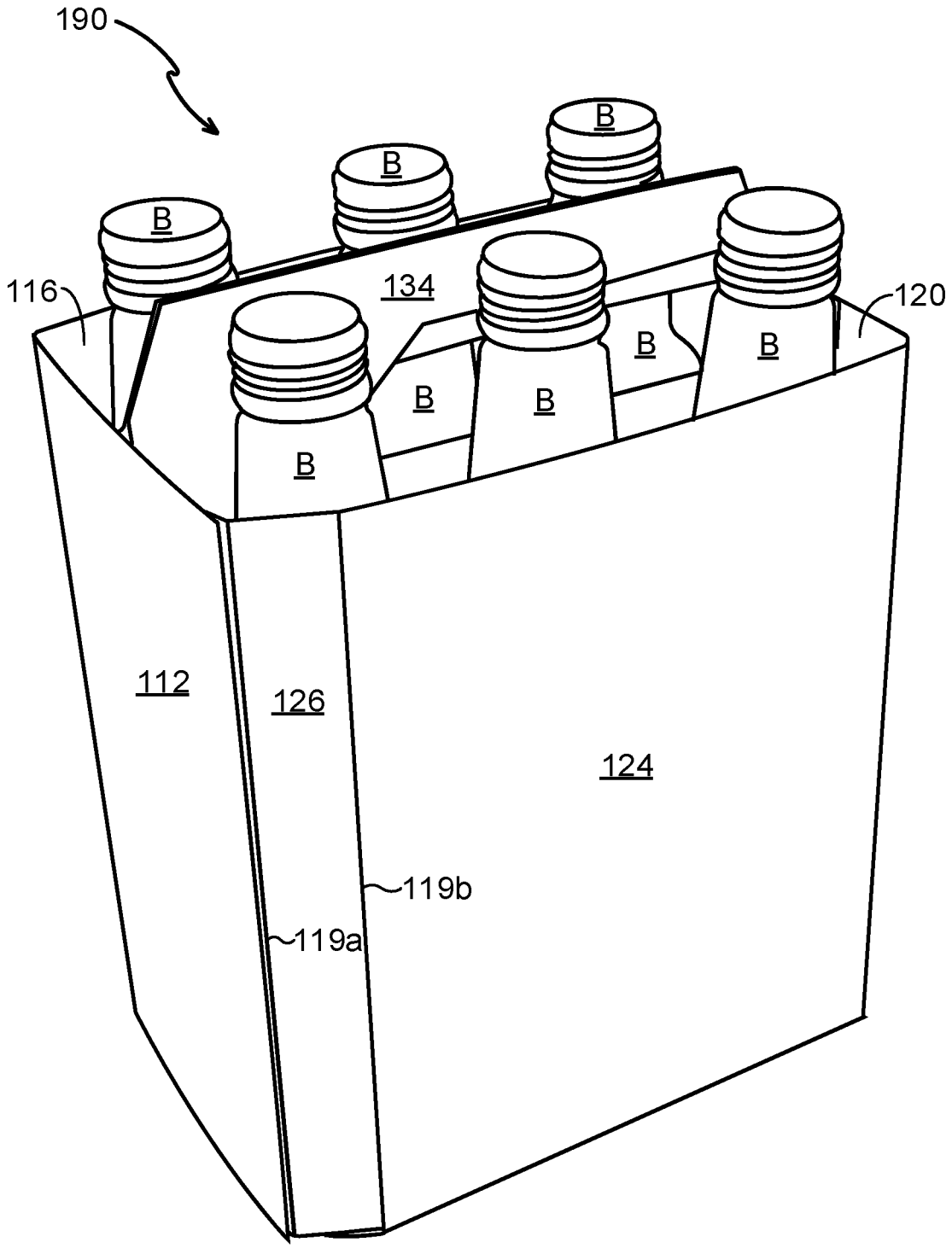
FIG. 10 is a perspective view from above of a carrier formed from the blank of FIG. 9.

The carrier 190 of the embodiment of FIGS. 9 and 10 comprise a pair of diagonally opposed square corners and a pair of diagonally opposed chamfered or bevelled corners. The square corners may be located at working crease corners of the carrier 190. The chamfered or bevelled corners may be located at non-working crease corners of the carrier 190.

The first corner panel and the third corner panel present in the embodiment of FIGS. 1 to 8 have been omitted from the embodiment of FIGS. 9 and 10. The fold lines 13*b*, 17*b* have likewise been omitted.

The first outer end panel 112 and first inner end panel 128 form a first primary panel 112/128 of the tubular structure.

The first side panel 116 and the second corner panel 118 form a second primary panel 116/118 of the tubular structure.

The second end panel 120 forms a third primary panel 120 of the tubular structure.

The second side panel 124 and the fourth corner panel 126 form a fourth primary panel 124/126 of the tubular structure.

The first primary panel 112/128 is hinged to the second primary panel 116/118 by a first hinged connection, in the form of a first fold line 113*a*.

The second primary panel 116/118 is hinged to the third primary panel 120 by a second hinged connection, in the form of a second fold line 115*b*.

The third primary panel 120 is hinged to the fourth primary panel 124/126 by a third hinged connection, in the form of a third fold line 117*a*.

The first primary panel 112/128 is hinged to the fourth primary panel 124/126 by a fourth hinged connection, in the form of a fourth fold line 119*b*, since the first inner end panel 128 is secured to the first outer end panel 112.

The blank 110 comprises a first base panel 136 hinged to the first side panel 116 by a hinged connection in the form of a fold line 127. The blank 110 comprises a second base panel 138 hinged to the second side panel 124 by a hinged connection in the form of a fold line 129.

The blank 10 comprises a medial structure including a first medial panel 130 and a second medial panel 134.

The first medial panel 130 is hingedly connected at a first end to the first inner end panel 128 by a hinged connection in the form of a fold line 121.

The second medial panel 134 is hingedly connected to the first medial panel 130 along a lower edge thereof by a hinged connection in the form of a fold line 125.

The first medial panel 130 provides a first handle structure H1. The second medial panel 34 provides a second handle structure H2. Together the first and second medial panels 30, 34 provide a two ply handle structure, the second ply reinforcing the first ply.

The blank 10 comprises a medial partition glue flap 132 hingedly connected to the first medial panel 30 along a second end (the second end opposes the first end, the first end is defined by fold line 21) by a hinged connection in the form of a fold line 23.

The blank 10 may comprise a first partition structure P1. The first partition structure P1 defines or creates a plurality of cells disposed between the first side panel 116 and the first medial panel 130. The first side panel 116 and the first medial panel 130 along with portions of the first and second end panels 112/128, 120 define a tubular structure or first compartment on a first side of the medial structure.

The first partition structure P1 comprises a first partition panel 154 struck from the first medial panel 130 and hingedly connected, at a first or proximal end, thereto by a hinged connection in the form of a fold line 155.

The first partition structure P1 comprises a second partition panel 150 struck from the first medial panel 130 and hingedly connected, at first or a proximal end, thereto by a hinged connection in the form of a fold line 151.

The first partition structure P1 comprises a first glue panel 152 to which the first and second partition panels 154, 150 are each coupled by distal end joints.

The first partition panel 154 is hingedly connected, at a second or distal end, to a first end of the first glue panel 150 by a hinged connection in the form of fold line 153. Fold line 153 defines an outer end of the first partition panel 154, fold line 155 defines an inner end of the first partition panel 154, and a linear dimension is defined therebetween.

The second partition panel 150 is coupled, at a second or distal end, to a second end of the first glue panel 152 (the second end opposes the first end) by a common connection in the form of twistable strip region.

Fold line 151 may be collinear with fold line 153 in the blank 10.

The second partition panel 150 is separated from the first glue panel 152 along or by a cut line or severance line.

Optionally, the blank 110 comprises a second partition structure P2. The second partition structure P2 defines a plurality of cells disposed between the second side panel 124 and the second medial panel 134. The second side panel 124 and the second medial panel 134 along with portions of the first and second end panels 112/128, 120 define a second tubular structure or compartment on a second side of the medial structure.

The second partition structure P2 comprises a third partition panel 168 struck from the second medial panel 134 and hingedly connected, at a first or proximal end, thereto by a hinged connection in the form of a fold line 167. Fold line 167 defines a proximal end of the third partition panel 168.

The second partition structure P2 comprises a pair of fourth partition panels 164*a*, 164*b* forming an upper fourth partition panel 164*b* and a lower fourth partition panel 164*a*. The pair of fourth partition panels 164*a*, 164*b* are struck from the second medial panel 134 and hingedly connected, at first or a proximal end, thereto by a hinged connections in the form of a fold lines 163*a*, 163*b*.

The second partition structure P2 comprises a second glue panel 166 to which the third partition panel 168 is coupled. The second glue panel 166 is hingedly connected to the third partition panel 168 by a hinged connection in the form of a fold line 165. Fold line 165 defines a distal end of the third partition panel 168.

The second glue panel 166 is interposed between the upper fourth partition panel 164*b* and the lower fourth partition panel 164*a*.

The second glue panel 166 spaces apart the upper fourth partition panel 164*b* and the lower fourth partition panel 164*a*.

A glue flap 162 is integral with the second glue panel 166, the glue flap 162 is hinged to each of the upper fourth partition panel 164*b* and the lower fourth partition panel 164*a* by fold lines 161*b*, 161*a* respectively.

Fold lines 161*b*, 161*b* define distal ends of the upper fourth partition panel 164*b* and the lower fourth partition panel 164*a* by fold lines 161*b*, 161*a* respectively.

Fold line 165 may be collinearly arranged with each of the fold lines 163*a*, 163*b*.

Construction of the embodiment of the blank of FIG. 9 into the carrier of FIG. 10 is substantially similar to the construction of the embodiment of FIGS. 1 to 8 and will not be described in further detail.

The fold lines 113*a*, 117*a* form working creases or folds. The fold lines 115*b*, 119*b* form non-working creases or folds. The fold or bend resistance of fold lines 115*b*, 119*b* is less than that of fold lines 113*a*, 117*a*.

The fold line 115*a* has a greater fold resistance than the fold line 115*b* to which it is adjacent to. Similarly, the fold line 119*a* has a greater fold resistance than the fold line 119*b* to which it is adjacent to. Thus when the carrier 190 is erected the carrier 190 folds initially at fold lines fold lines 115*b*, 119*b*, the carrier 190 may subsequently fold at fold lines 115*a*, 119*a* for example, but not limited to, upon loading of the carrier 190 with articles B.

The blank 110/carrier 190 may be pre-folded at fold lines 113*a*, 117*a*.

Figure 11:
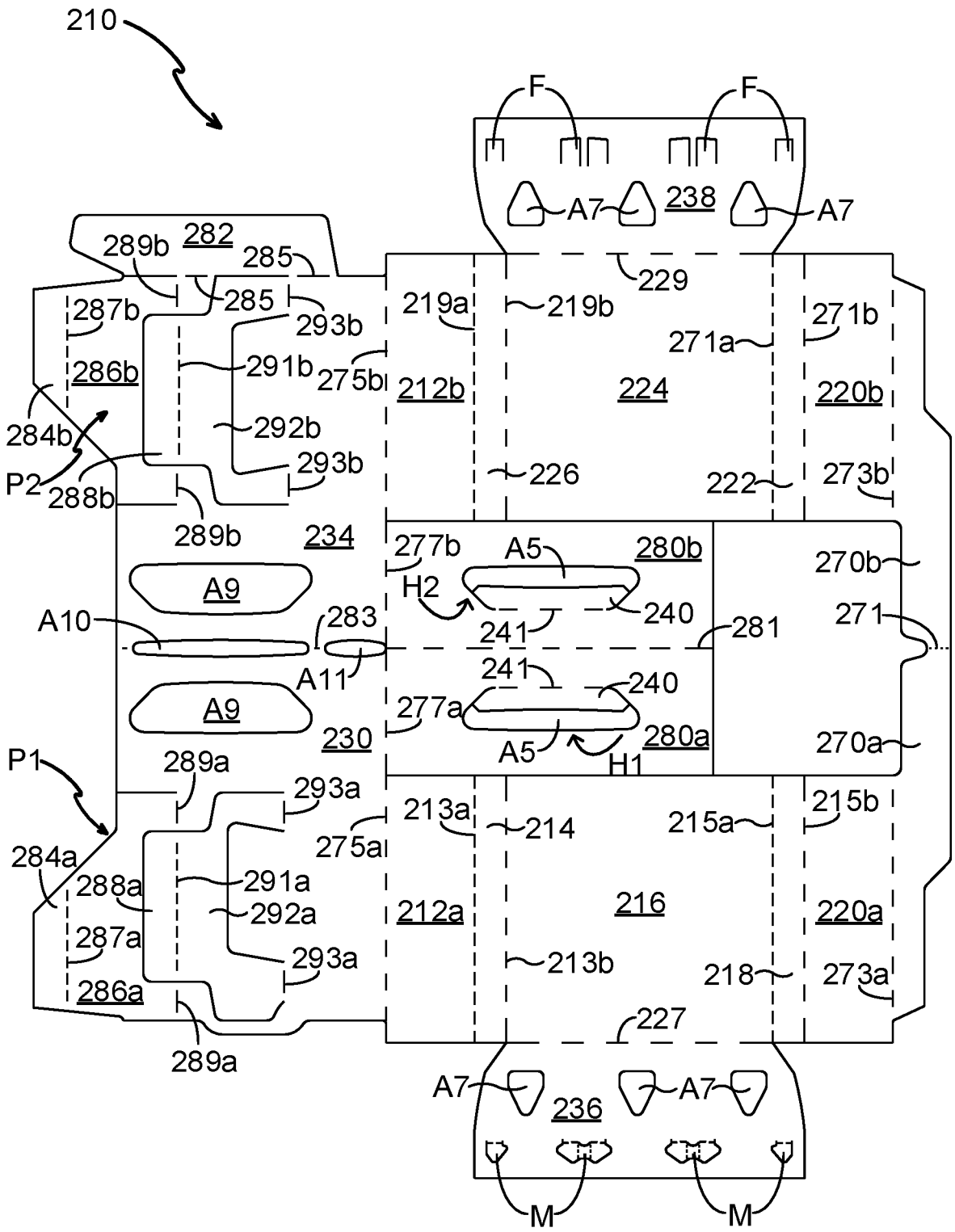
FIG. 11 is a plan view from above of a blank for forming a carrier according to a third embodiment.

Referring now to the embodiment of FIG. 11 there is shown a third illustrated embodiment comprising a blank 210 for forming a carrier (not shown).

The blank 210 comprises a first end panel 212*a* hingedly connected to a first corner panel 214 by a fold line 213*a*. The first corner panel 214 is hingedly connected to a first side panel 216 by a fold line 213*b*. The first side panel 216 is hingedly connected to a second corner panel 218 by a fold line 215*a*. The second corner panel 218 is hingedly connected to a second end panel 220*a* by a fold line 215*b*.

A first medial panel 230 is hingedly connected to the first end panel 212*a* by a hinged connection in the form of a fold line 275*a*.

A first riser panel 270*a* is hingedly connected to the second end panel 220*a* by a hinged connection in the form of a fold line 273*a*.

The first medial panel 230, first end panel 212*a*, first corner panel 214, first side panel, second corner panel, second end panel 220*a* and first riser panel 270*a* are arranged in first linear series.

The blank 210 comprises a third end panel 212*b* hingedly connected to a third corner panel 226 by a fold line 219*a*. The third corner panel 226 is hingedly connected to a second side panel 224 by a fold line 219*b*. The second side panel 224 is hingedly connected to a fourth corner panel 222 by a fold line 217*a*. The fourth corner panel 222 is hingedly connected to a fourth end panel 220*b* by a fold line 217*b*.

A second medial panel 234 is hingedly connected to the third end panel 212*b* by a hinged connection in the form of a fold line 275*b*.

A second medial panel 234, second riser panel 270*b* is hingedly connected to the fourth end panel 220*b* by a hinged connection in the form of a fold line 273*b*.

The third end panel 212*b*, third corner panel 226, second side panel 224, fourth corner panel 222, fourth end panel 220*b* and second riser panel 273*b* are arranged in second linear series.

The first and second linear series are spaced apart from each other. In the illustrated embodiment an optional pair of handle reinforcing panels 280*a*, 280*b* are disposed between the first and second linear series.

The first riser panel 270*a* is hingedly connected to the second riser panel 270*b* by a hinged connection in the form of a fold line 271.

The first medial panel 230 is hingedly connected to the second medial panel 234 by a hinged connection in the form of a fold line 283. The fold line 283 may be interrupted by at least one fold relief device in the form of cutaways, apertures or slots A10, A11; the illustrated embodiment comprises a pair of apertures A10, A11.

The pair of handle reinforcing panels 280*a*, 280*b* comprises a first handle reinforcing panel 280*a* hingedly connected to an upper portion of the first medial panel 230 by a hinged connection in the form of a fold line 277*a* and a second handle reinforcing panel 280*b* hingedly connected to an upper portion of the second medial panel 234 by a hinged connection in the form of a fold line 277*b*.

The first and second medial panels 230, 234 comprise a first handle openings A9 and the first and second handle reinforcing panel 280*a*, 280*a* comprise a second handle openings H1, H2 arranged to be in registry with a respective one of the first handle openings A9. The second handle opening may comprise a handle aperture A5 and a cushioning flap 240. Each cushioning flap 240 is hinged to the respective one of the first and second handle reinforcing panels 280*a*, 280*a* by a fold line 241.

The blank 210 comprises a first base panel 236 hinged to the first side panel 216 by a hinged connection in the form of a fold line 227. The blank 210 comprises a second base panel 238 hinged to the second side panel 224 by a hinged connection in the form of a fold line 229.

The first medial panel 230 comprises a first partition structure P1 comprising a pair of partition panel 286*a*, 292*a* each hinged to the first medial panel 230 by a respective fold line 289*a*, 293*a*. The fold lines 289*a*, 293*a* define proximal ends of the pair of partition panel 286*a*, 292*a*.

A first glue panel 284*a* is hinged to a first partition panel 286*a* at a distal end by a fold line 287*a*. A second glue panel 288*a* is hinged to a second partition panel 292*a* at a distal end by a fold line 291*a*. The second glue panel 288*a* may be struck, at least in part, from the first partition panel 286*a* so as to interrupt the fold line 289*a*. The fold line 289*a* may be collinear with the fold line 291*a*.

The second partition panel 292*a* may be interrupted by a tab integral with the first medial panel 230, the tab may be considered to be struck from, or defined in, the second partition panel 292*a*. The tab interrupts the fold line 293*a*, such that the fold line 293*a* comprises two spaced apart fold lines.

The second medial panel 234 comprises a second partition structure P2 comprising a pair of partition panel 286*b*, 292*b* each hinged to the second medial panel 234 by a respective fold line 289*b*, 293*b*. The fold lines 289*b*, 293*b* define proximal ends of the pair of partition panel 286*b*, 292*b*.

A third glue panel 284*b* is hinged to a third partition panel 286*b* at a distal end by a fold line 287*b*. A fourth glue panel 288*b* is hinged to a fourth partition panel 292*b* at a distal end by a fold line 291*b*. The fourth glue panel 288*a* may be struck, at least in part, from the third partition panel 286*b* so as to interrupt the fold line 289*b*. The fold line 289*b* may be collinear with the fold line 291*b*.

The fourth partition panel 292*b* may be interrupted by a tab integral with the first medial panel 234, the tab may be considered to be struck from, or defined in, the fourth partition panel 292*b*. The tab interrupts the fold line 293*b*, such that the fold line 293*b* comprises two spaced apart fold lines.

A connecting or bridging panel 282 is hinged to a lower edge of the second medial panel 234 by a fold line 285. The connecting panel 282 is separated from the third and fourth partition panels 286*b*, 292*b* by cutaways in the form of cut lines.

Turning to the construction of a carrier from the blank of FIG. 11, the carrier can be formed by a series of sequential folding operations in a straight-line machine so that the carrier is not required to be rotated or inverted to complete its construction. The folding process is not limited to that described below and may be altered according to particular manufacturing requirements.

Figure 12:
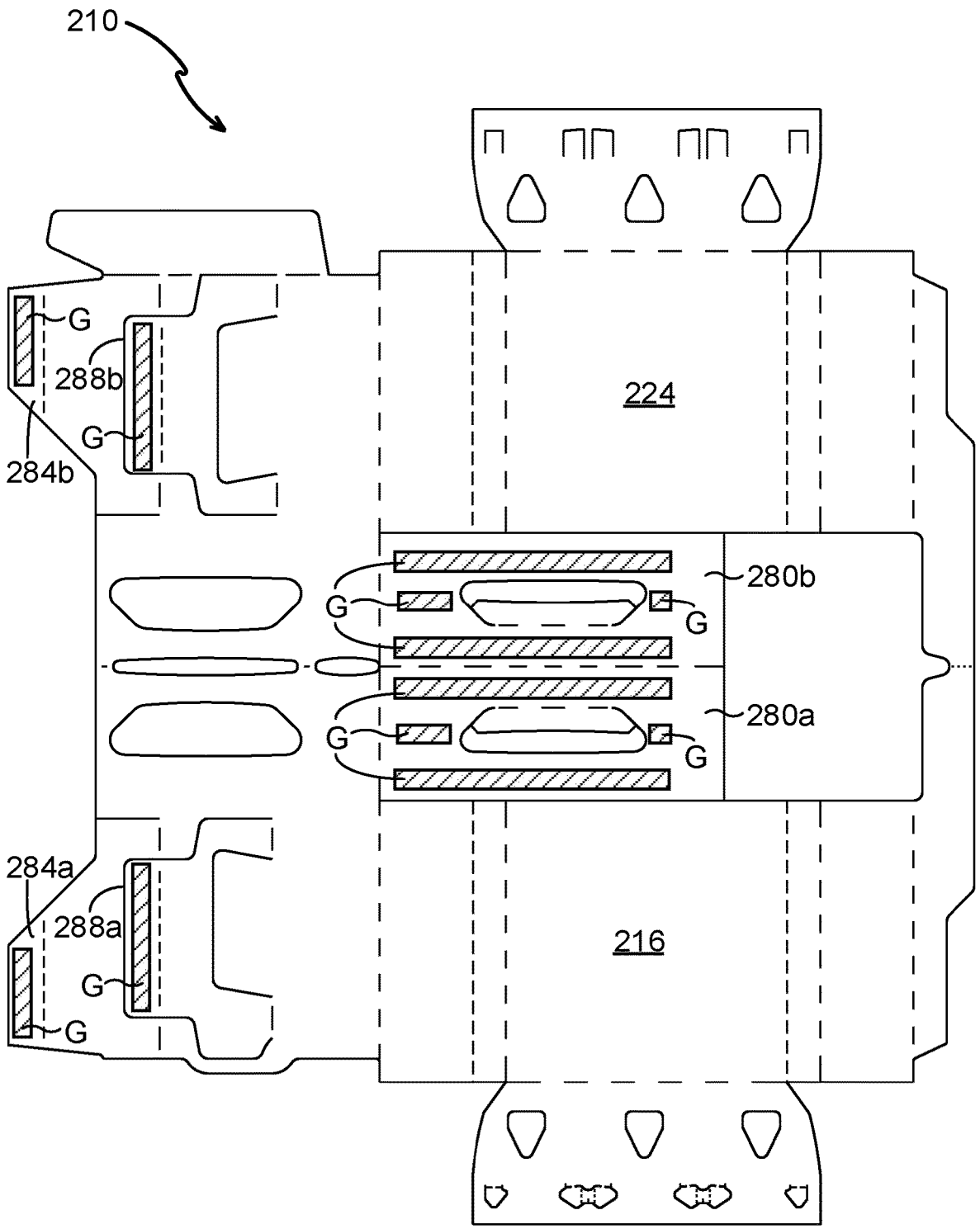
FIGS. 12 to 16 illustrate stages of construction of the blank of FIG. 11 into a flat collapsed carrier.

Glue or other adhesive treatment G is applied to the first, second, third and fourth glue panels 284*a*, 288*a*, 284*b*, 288*b* or to corresponding regions of the first and second side panels 216, 224 as shown in FIG. 12.

Glue or other adhesive treatment G is applied to the first and second handle reinforcing panels 280*a*, 280*b* or to corresponding regions of the first and second medial panels 230, 234.

Figure 13:
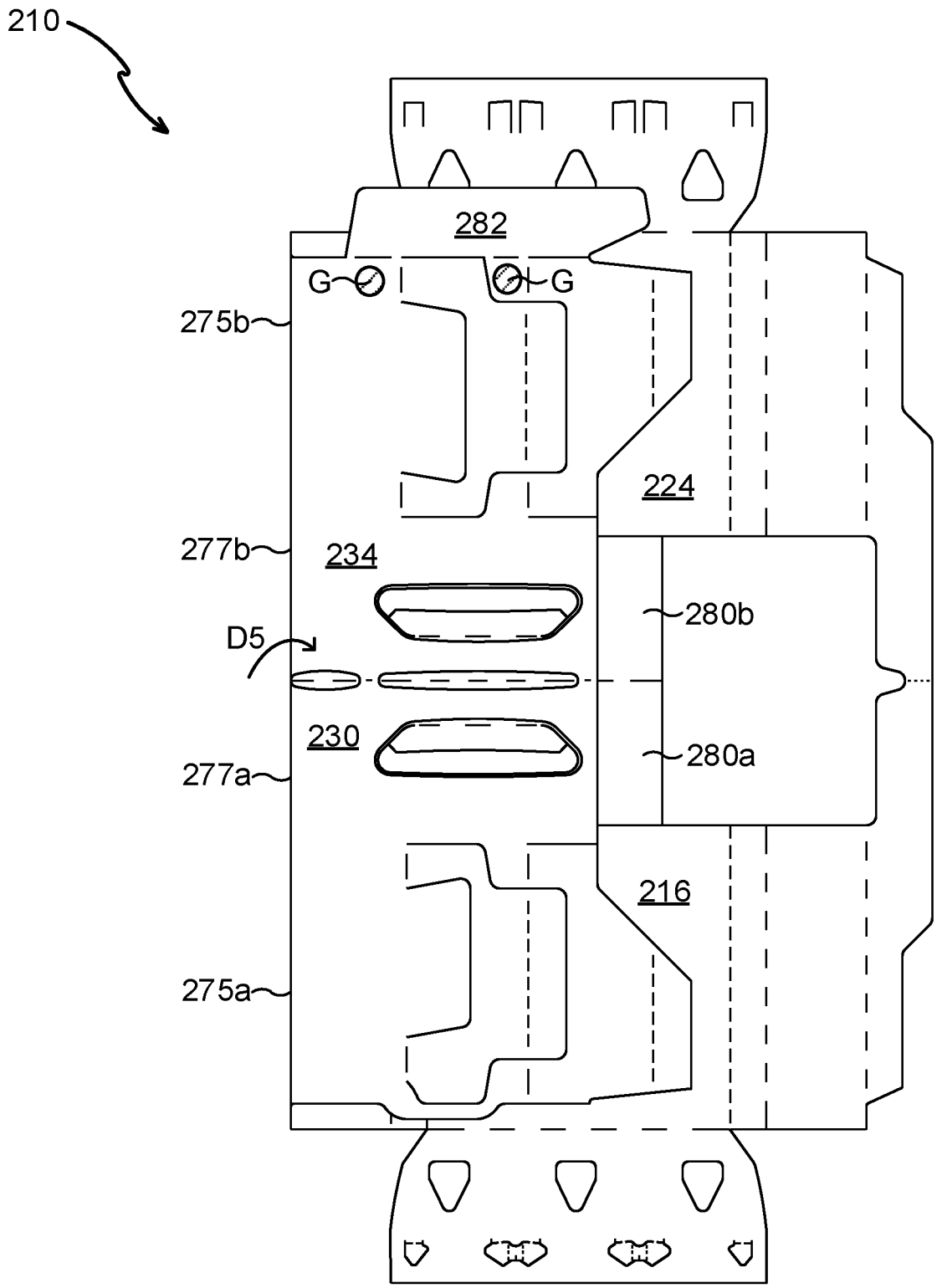

The first medial panel 230 and second medial panel 234 are folded about fold lines 275*a*, 277*a*, 275*b*, 277*b* as indicated by direction arrow D5 in FIG. 13. The first medial panel 230 is brought into face contacting relationship with the first side panel 216. The first and second glue panels 284*a*, 288*a* are secured to the first side panel 216. The second medial panel 234 is brought into face contacting relationship with the second side panel 224. The third and fourth glue panels 284*b*, 288*b* are secured to the second side panel 224.

An upper portion of the first medial panel 230 is brought into face contacting relationship with first handle reinforcing panel 280*a*. The upper portion of the first medial panel 230 is secured to the first handle reinforcing panel 280*a*.

An upper portion of the second medial panel 234 is brought into face contacting relationship with the second handle reinforcing panel 280*b*. The upper portion of the second medial panel 234 is secured to the second handle reinforcing panel 280*b*.

Glue or other adhesive treatment G is applied to portion of the second medial panel 234 adjacent to the connecting panel 282. Alternatively, glue or other adhesive treatment may be applied to a corresponding regions of the connecting panel 282.

Figure 14:
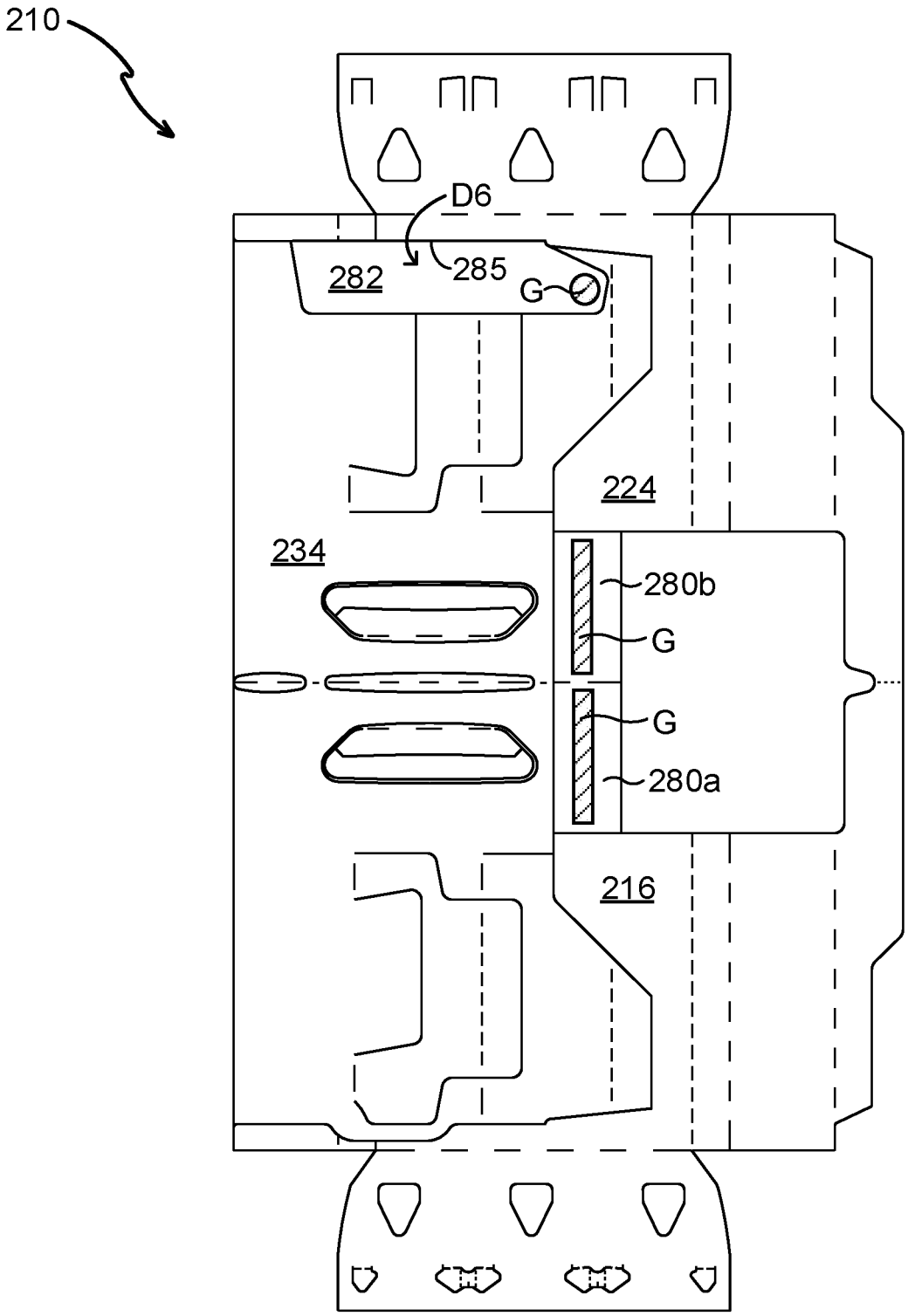

The connecting panel 282 is folded with respect to the second medial panel 234 about fold line 283 as indicated by direction arrow D6 in FIG. 14.

Glue or other adhesive treatment G is applied to an end portion of the connecting panel 282. Alternatively, glue or other adhesive treatment may be applied to a corresponding region of the second riser panel 270*b*.

Glue or other adhesive treatment G is applied to end portions of the first and second handle reinforcing panels 280*a*, 280*b*. Alternatively, glue or other adhesive treatment may be applied to a corresponding regions of the first and second riser panels 270*a*, 270*b*.

Figure 15:
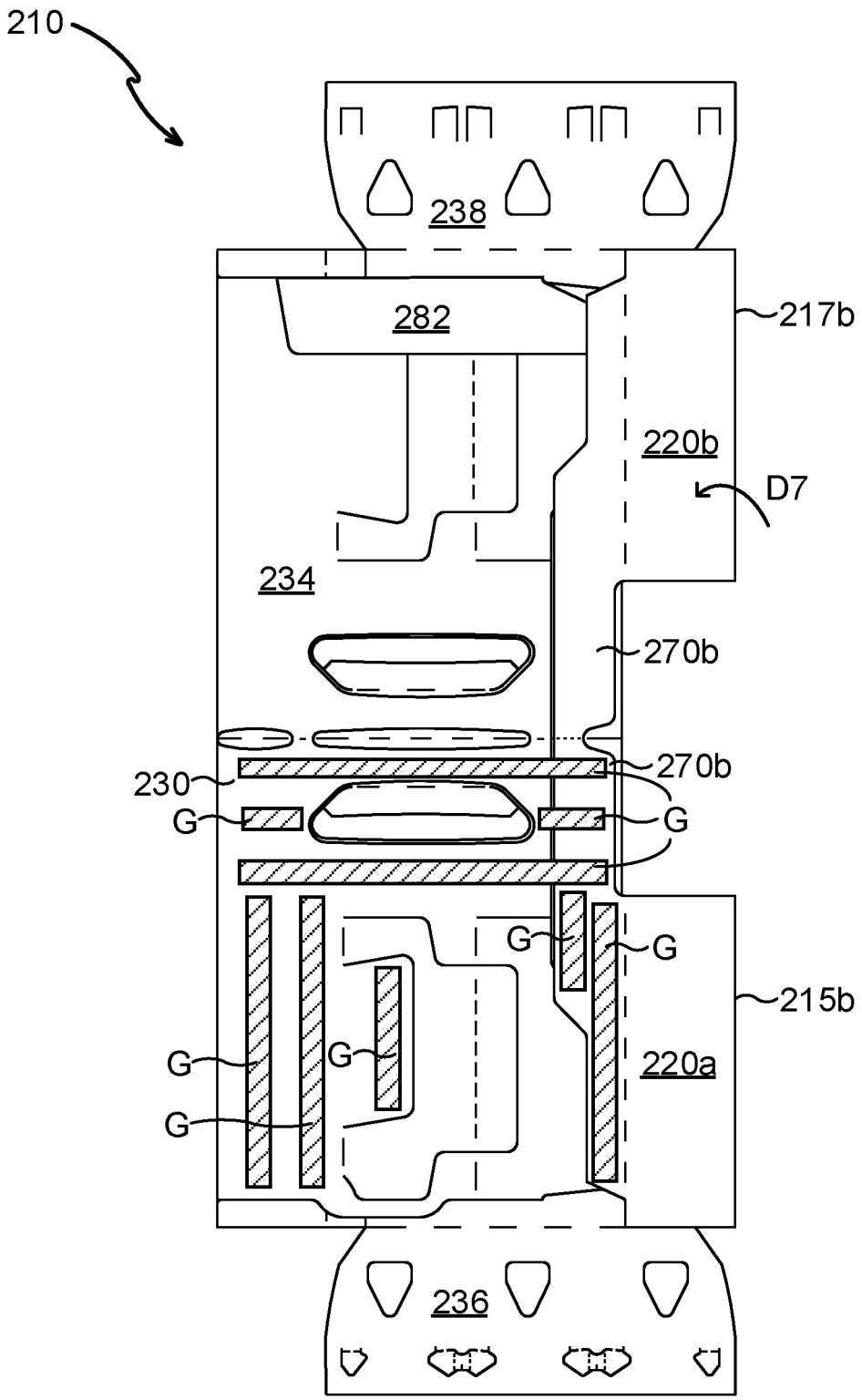

The second and fourth end panels 220*a*, 220*b* together with the first and second riser panels 270*a*, 270*b* are folded about fold lines 215*b*, 217*b* respectively, as indicated by direction arrow D7 in FIG. 15.

The first riser panel 270*a* is brought into face contacting relationship with the first handle reinforcing panel 280*a*. The first riser panel 270*a* is secured to the first handle reinforcing panel 280*a*.

The second riser panel 270*b* is brought into face contacting relationship with the second handle reinforcing panel 280*b*. The second riser panel 270*b* is secured to the second handle reinforcing panel 280*b*.

The second riser panel 270*b* is brought into face contacting relationship with and end portion of the connecting panel 282. The second riser panel 270*b* is secured to the connecting panel 282.

Glue or other adhesive treatment is applied to the first medial panel 230. Alternatively, glue or other adhesive treatment may be applied to a corresponding region of the second medial panel 234.

Glue or other adhesive treatment is applied to the first riser panel 270*a*. Alternatively, glue or other adhesive treatment may be applied to a corresponding region of the second riser panel 270*b*.

Figure 16:
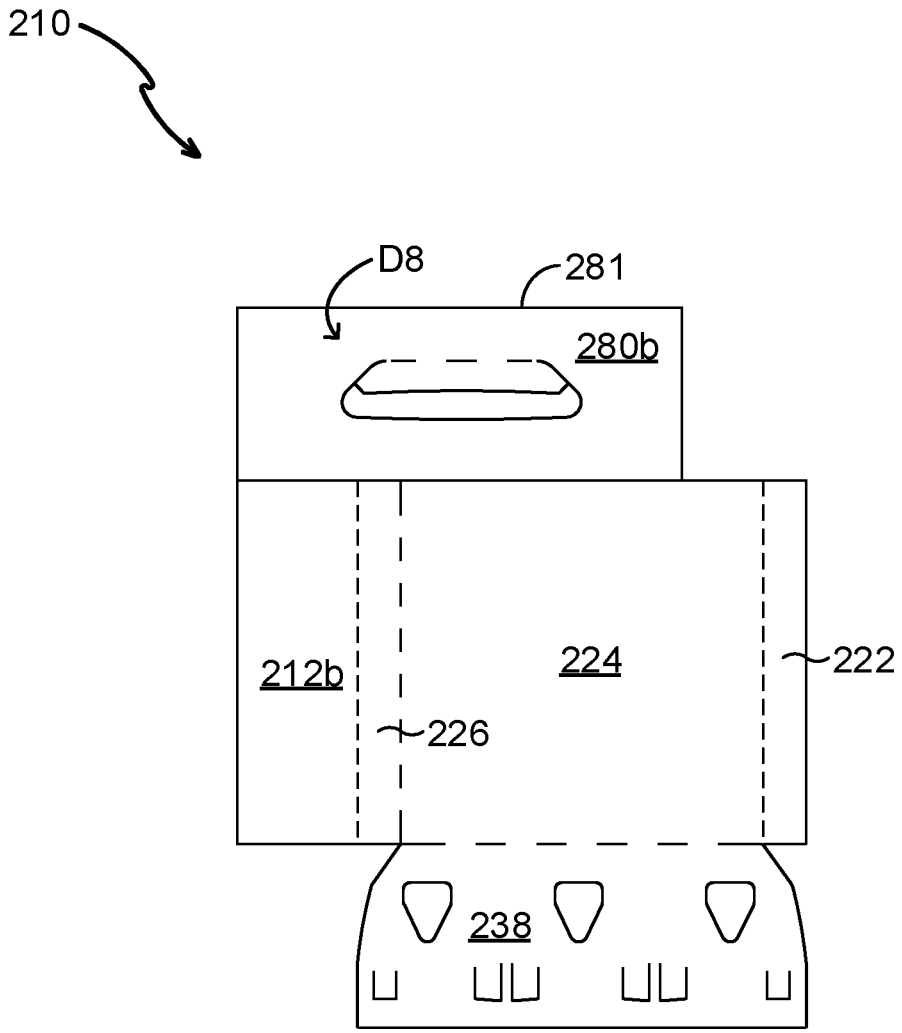

The blank 210 is folded about fold lines 281, 283 to bring the second medial panel 234 in face contacting relationship with the first medial panel 230 as indicated by direction arrow D8 in FIG. 16. The second riser panel 270*b* is brought into face contacting relationship with the first riser panel 270*a*.

The second medial panel 234 is secured to the first medial panel 230. The second riser panel 270*b* is secured to the first riser panel 270*a*.

In this way a flat collapsed tubular structure is formed. The flat collapsed carrier can be readily shipped or distributed in the flat condition to a plant for erecting and loading with primary product containers.

The flat collapsed carrier can be opened into a basket-style article carrier by separating the first and second side panels 216, 224 to form a tubular structure defined by the primary panels. The primary panels define an interior chamber. The partition structures P1, P2 are automatically erected when the flat collapsed carrier is opened out or erected into the tubular form.

Once the carrier is erected, the first and second medial panels 230, 234 form a partition that is disposed medially within the interior of the carrier. The partition divides the interior of the carrier into two separate compartments on opposing sides of the first and second medial panels 230, 234.

The first and third end panels 212*a*, 212*b* form a first primary panel 212*a*/212*b*. The first primary panel 212*a*/212*b* forms a first end wall of the erected carrier.

The first side panel 216 and first and second corner panels 214, 218 form a second primary panel 216/214/218. The second primary panel 216/214/218 forms a first side wall of the erected carrier.

The second and fourth end panels 220*a*, 220*b* form a third primary panel 220*a*/220*b*. The third primary panel 220*a*/220*b* forms a second end wall of the erected carrier.

The second side panel 224 and third and fourth corner panels 226, 222 form a fourth primary panel 224/226/222. The fourth primary panel 224/226/222 forms a second side wall of the erected carrier.

The first primary panel 212*a*/212*b* is hingedly connected to the second primary panel 216/214/218 by a first hinged connection in the form of fold line 213*a* which is a non-working crease or fold, that is to say in the flat collapsed form shown in FIG. 16 the a first portion of the first primary panel 212*a*/212*b* is substantially coplanar (unfolded) with respect to the second primary panel 216/214/218.

The third primary panel 220*a*/220*b* is hingedly connected to the second primary panel 216/214/218 by a second hinged connection in the form of fold line 215*b* which is working crease or fold, that is to say in the flat collapsed form shown in FIG. 16 the third primary panel 220*a*/220*b* is folded with respect to the second primary panel 216/214/218 about the fold line 215*b*.

The third primary panel 220*a*/220*b* is hingedly connected to the fourth primary panel 224/226/222 by a third hinged connection in the form of fold line 217*b* which is working crease or fold, that is to say in the flat collapsed form shown in FIG. 16 the third primary panel 220*a*/220*b* is folded with respect to the fourth primary panel 224/226/222 about the fold line 217*b*.

The first primary panel 212*a*/212*b* is hingedly connected to the fourth primary panel 224/226/222 by a fourth hinged connection in the form of fold line 219*a* which is a non-working crease or fold, that is to say in the flat collapsed form shown in FIG. 16 the a second portion of the first primary panel 212*a*/212*b* is substantially coplanar (unfolded) with respect to the fourth primary panel 224/226/222.

The first hinged connection 213*a* comprises a lower fold resistance than the second hinged connection 215*b*. That is to say the force required to fold the substrate material bout fold line 213*a* is less than that required to fold the substrate material about the fold line 215*b*.

The fold resistance of the first hinged connection 213*a* is substantially equal to the fourth hinged connection 219*a*.

The first hinged connection 213*a* comprises a lower fold resistance than the third hinged connection 217*b*.

The fold resistance of the second hinged connection 215*b* is substantially equal to the third hinged connection 217*b*.

The fourth hinged connection 219*a* comprises a lower fold resistance than the second hinged connection 215*b*.

The fourth hinged connection 219*a* comprises a lower fold resistance than the third hinged connection 217*b*.

The present disclosure provides a package comprising a carton or article carrier 90; 190 loaded with one or more articles B. The carrier 90; 190 comprises a plurality of main or primary panels defining an interior of the carrier 90; 190.

The carrier 90; 190 comprises a collapsible tubular structure which comprises a first primary panel 12/28; 112/128, a second primary panel 14/16/18; 116/118, a third primary panel 20; 120 and a fourth primary panel 22/24/26; 124/126. The first and second primary panels 12/28; 112/128, 14/16/18; 116/118 are hingedly connected by a first hinged connection 13*a*; 113*a*. The second and third primary panels 14/16/18; 116/118, 20; 120 are hingedly connected by a second hinged connection 15*b*; 115*b*. The third and fourth primary panels 20; 120, 22/24/26; 124/126 are hingedly connected by a third hinged connection 17*a*; 117*a*. The fourth and first primary panels 12/28; 112/128, 22/24/26; 124/126 are hingedly connected by a fourth hinged connection 19*b*; 119*b*. The first hinged connection 13*a*; 113*a* may be greater in fold resistance than each of the second and fourth hinged connections 15*b*; 115*b*, 19*b*; 119*b*.

The third hinged connection 17*a*; 117*a* may be greater in fold resistance than each of the second and fourth hinged connections 15*b*; 115*b*, 19*b*; 119*b*. The first hinged connection 13*a*; 113*a* may be substantially equal in fold resistance to the third hinged connection 17*a*; 117*a*. The second hinged connection 15*b*; 115*b* may be substantially equal in fold resistance to the fourth hinged connection 19*b*; 119*b*.

The second primary panel 14/16/18 may comprise a first corner panel portion 14 and a main panel portion 16. The first corner panel portion 14 may be hingedly connected to the first primary panel 12/28 by the first hinged connection 13*a* and to the main panel portion 16 by a first corner hinged connection 13*b*. The first hinged connection 13*a* may be greater in fold resistance than the first corner hinged connection 13*b*.

The second primary panel 14/16/18; 116/118 may comprise a second corner panel portion 18; 118 and a main panel portion 16; 116. The second corner panel portion 18; 118 may be hingedly connected to the third primary panel 20; 120 by the second hinged connection 15*b*; 115*b* and to the main panel portion 16; 116 by a second corner hinged connection 15*a*; 115*a*. The second corner hinged connection 15*a*; 115*a* may be greater in fold resistance than the second hinged connection 15*b*; 115*b*.

The first corner hinged connection 13*b* may be substantially equal in fold resistance to the second hinged connection 15*b*.

The fourth primary panel 22/24/26 may comprise an additional corner panel portion 22 and a second main panel portion 24. The additional corner panel portion 22 may be hingedly connected to the third primary panel 20 by the third hinged connection 17*a* and to the second main panel portion 24 by an additional corner hinged connection 17*b*. The third hinged connection 17*a* may be greater in fold resistance than the additional corner hinged connection 17*b*.

The fourth primary panel 22/24/26; 124/126 may comprise a further corner panel portion 26; 126 and a second main panel portion 24; 124. The further corner panel portion 26; 126 may be hingedly connected to the first primary panel 12/28; 112/128 by the fourth hinged connection 19*b*; 119*b* and to the second main panel portion 24; 124 by a further corner hinged connection 19*a*; 119*a*. The further corner hinged connection 19*a*; 119*a* is greater in fold resistance than the fourth hinged connection 19*b*; 119*b*.

The carrier 90; 190 may comprise a partition structure for dividing the interior of the carrier 90; 190 into two or more compartments. The partition structure may include a primary divider panel 30; 130; 230, 234 hingedly connected to both the first and third primary panels 12/28, 20; 112/128, 120; 212*a*/212*b*, 220*a*/220*b* such that tubular structure may be collapsed with the primary divider panel 30; 130; 230 disposed in a face contacting arrangement with the inside surfaces of the second and fourth primary panels 14/16/18, 22/24/26; 116/118, 124/126; 214/216/218, 226/224/222. The primary divider panel 30; 130; 230, 234 may be hingedly connected to the first primary panel 12/28; 112/128; 212*a*/212*b* by a fifth hinged connection 21; 121; 275*a*, 275*b* and to the third primary panel by a sixth hinged connection 23; 123; 273*a*, 273*b*. The fifth hinged connection 21; 121; 275*a*, 275*b* may be greater in fold resistance that the sixth hinged connection 23; 123; 273*a*, 273*b*.

Another aspect of the present disclosure provides a carrier 90; 190; 290 comprising a collapsible tubular structure which comprises a first primary panel 12/28; 112/12; 212*a*/212*b*, a second primary panel 14/16/18; 116/118; 214/216/218, a third primary panel 20; 120; 220*a*/220*b* and a fourth primary panel 22/24/26; 124/126; 226/224/222. The first and second primary panels are hingedly connected by a first hinged connection 13*a*; 113*a*; 213*a*. The second and third primary panels are hingedly connected by a second hinged connection 15*b*; 115*b*; 215*b*. The third and fourth primary panels are hingedly connected by a third hinged connection 17*b*; 117*b*; 217*b*. The fourth and first primary panels are hingedly connected by a fourth hinged connection 19*b*; 119*b*; 219*a*. The first hinged connection 13*a*; 113*a*; 213*a* may comprise a lower fold resistance than the second hinged connection 15*b*; 115*b*; 215*b*. The first hinged connection 213*a* may comprise a fold resistance substantially equal in fold strength to the fourth hinged connection 219*a*.

The third hinged connection 217*b* may comprise a greater fold resistance than the fourth hinged connection 219*a* and substantially equal in fold strength to the second hinged connection 215*b*.

The first hinged connection 213*a* may comprise a lower fold resistance than the third hinged connection 217*b*.

The second hinged connection 215*b* may comprise a greater fold resistance than the fourth hinged connection 219*a*

The second primary panel 214/216/218 may comprise a first corner panel portion 214 and a main panel portion 216. The first corner panel portion 214 may be hingedly connected to the first primary panel 216 by the first hinged connection 213*a* and to the main panel portion 216 by a first corner hinged connection 213*b*. The first hinged connection 213*a* may comprise a lower fold resistance than the first corner hinged connection 213*b*.

The second primary panel 214/216/218 may comprise a second corner panel portion 218. The second corner panel portion 218 may be hingedly connected to the third primary panel 220*a*/220*b* by the second hinged connection 215*b* and to the main panel portion 216 by a second corner hinged connection 215*a*. The second corner hinged connection 215*a* may comprise a lower fold resistance than the second hinged connection 215*b*.

The first corner hinged connection 213*b* may be substantially equal in fold resistance to the second hinged connection 215*b*.

The fourth primary panel 226/224/222 may comprise an additional corner panel portion 222 and a second main panel portion 224. The additional corner panel portion 222 may be hingedly connected to the third primary panel 220*a*/220*b* by the third hinged connection 217*b* and to the second main panel portion 224 by an additional corner hinged connection 217*a*. The third hinged connection 217*b* may be greater in fold resistance than the additional corner hinged connection 217*a*.

The fourth primary panel 226/224/222 comprises a further corner panel portion 226 and a second main panel portion 224. The further corner panel portion 226 may be hingedly connected to the first primary panel 212*a*/212*b* by the fourth hinged connection 219*a* and to the second main panel portion 224 by a further corner hinged connection 219*b*. The further corner hinged connection 219*b* may be greater in fold resistance than the fourth hinged connection 219*a*.

An aspect of the disclosure provides a carrier 90; 190 comprising a partition structure for dividing the interior of the carton into two or more compartments. The partition structure includes a divider panels 30,34; 130,134; 230, 234 hingedly connected to both the first and third primary panels 12/28,20; 112/128, 120; 212*a*/22*b*, 220*a*/220*b* such that tubular structure may be collapsed with the divider panels being in a face contacting arrangement with the inside surfaces of the second and fourth primary panels 14/16/18, 22/24/26; 116/118, 124/126; 214/216/218, 226/224/226. The divider panels being hingedly connected to the first primary panel 12/28; 112/128; 212*a*/22*b*, by a fifth hinged connection 21; 121; 275*a*/257*b* and to the third primary panel 20; 120; 220*a*/220*b* by a sixth hinged connection 23; 123; 273*a*/273*b*. The fifth hinged connection may be greater in fold resistance that the sixth hinged connection.

A further aspect of the disclosure provides a carrier 90; 190 comprising a collapsible tubular structure which comprises a first primary panel 12/28; 112/128; 212*a*/212*b*, a second primary panel 14/16/18; 116/118; 214/216/218, a third primary panel 20; 120; 220*a*/220*b* and a fourth primary panel 22/24/26; 124/126; 226/224/222. The first and second primary panels are hingedly connected by a first hinged connection 13*a*; 113*a*; 213*a*. The second and third primary panels are hingedly connected by a second hinged connection 15*b*; 115*b*; 215*b*. The third and fourth primary panels are hingedly connected by a third hinged connection 17*a*; 117*a*; 217*b*. The fourth and first primary panels are hingedly connected by a fourth hinged connection 19*b*; 119*b*; 219*a*. The second primary panel 14/16/18; 116/118; 214/216/218 comprises a first corner panel portion 14; 118; 214 and a main panel portion 16; 116; 216. The first corner panel portion 14; 118; 214 hingedly connected to the first primary panel 12/28; 211*a*/212*b* by the first hinged connection 13*a*; 213*a* and to the main panel portion 16; 216 by a first corner hinged connection 13*b*; 213*b*. The first hinged connection 13*a*; 213*a* is greater or less in fold resistance than the first corner hinged connection 13*b*; 213*b*.

The first hinged connection 13*a* may be a working fold line and the first hinged connection 13*a* is greater in fold resistance than the first corner hinged connection 13*b*.

The first hinged connection 213*a* may be a non-working fold line and the first hinged connection 213*a* is less in fold resistance than the first corner hinged connection 213*b*.

It can be appreciated that various changes may be made within the scope of the present invention. For example, the size and shape of the panels and apertures may be adjusted to accommodate articles of differing size or shape. The present invention is not limited to cartons of the basket carrier style, the invention may be employed with other carton styles such as, but not limited to, open top crates, lidded or closed top crates and fully enclosed cartons.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another. Similarly, numeric references such as "first", "second", "third" are not limiting and merely serve to distinguish panels or features from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line or a severance line or both. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier comprising a collapsible tubular structure which comprises a first primary panel, a second primary panel, a third primary panel and a fourth primary panel wherein the first and second primary panels are hingedly connected, the second and third primary panels are hingedly connected, the third and fourth primary panels are hingedly connected, the fourth and first primary panels are hingedly connected, and wherein either: (i) a first hinged connection between the first and second primary panels is greater in fold resistance than each of a second hinged connection between the second and third primary panels and a fourth hinged connection between the fourth and first primary panels, or (ii) the first hinged connection is less in fold resistance than the second hinged connection and substantially equal in fold resistance to the fourth hinged connection.

2. An article carrier according to claim 1 wherein a third hinged connection between the third and fourth primary panels is greater in fold resistance than each of the second and fourth hinged connections.

3. An article carrier according to claim 1 wherein: (i) the first hinged connection is substantially equal in fold resistance to a third hinged connection between the third and fourth primary panels, or (ii) the second hinged connection is substantially equal in fold resistance to the fourth hinged connection, or (iii) both (i) and (ii).

4. An article carrier according to claim 1 wherein the second primary panel comprises a first corner panel portion and a main panel portion, the first corner panel portion being hingedly connected to the first primary panel by the first hinged connection and to the main panel portion by a first corner hinged connection wherein: (i) the first hinged connection is greater in fold resistance than the first corner hinged connection, or (ii) the first corner hinged connection is substantially equal in fold resistance to the second hinged connection, or (iii) both (i) and (ii).

5. An article carrier according to claim 4 wherein the second primary panel further comprises a second corner panel portion, the second corner panel portion being hingedly connected to the third primary panel by the second hinged connection and to the main panel portion by a second corner hinged connection wherein the second corner hinged connection is greater in fold resistance than the second hinged connection.

6. An article carrier according to claim 4 wherein the fourth primary panel comprises an additional corner panel portion and a second main panel portion, the additional corner panel portion being hingedly connected to the third primary panel by the third hinged connection and to the second main panel portion by an additional corner hinged connection wherein the third hinged connection is greater in fold resistance than the additional corner hinged connection.

7. An article carrier according to claim 4 wherein the fourth primary panel comprises a further corner panel portion and a second main panel portion, the further corner panel portion being hingedly connected to the first primary panel by the fourth hinged connection and to the second main panel portion by a further corner hinged connection wherein the further corner hinged connection is greater in fold resistance than the fourth hinged connection.

8. An article carrier according to claim 1 wherein the second primary panel comprises a corner panel portion and a main panel portion, the corner panel portion being hingedly connected to the third primary panel by the second hinged connection and to the main panel portion by a corner hinged connection wherein the corner hinged connection is: (i) greater in fold resistance than the second hinged connection, or (ii) substantially equal in fold resistance to the first hinged connection, or (iii) less in fold resistance than the second hinged connection, or (iv) both (i) and (ii), or (v) both (ii) and (iii).

9. An article carrier according to claim 1 further comprising a partition structure for dividing an interior of the article carrier into two or more compartments, the partition structure including a primary divider panel hingedly connected to both the first and third primary panels such that tubular structure may be collapsed with the primary divider panel being in a face contacting arrangement with the inside surfaces of the second and fourth primary panels, the primary divider panel being hingedly connected to the first primary panel by a fifth hinged connection and to the third primary panel by a sixth hinged connection, and wherein the fifth hinged connection is greater in fold resistance that the sixth hinged connection.

10. An article carrier according to claim 1 wherein a third hinged connection between the third and fourth primary panels is greater in fold resistance than the fourth hinged connection and substantially equal in fold resistance to the second hinged connection.

11. An article carrier according to claim 10 wherein: (i) the first hinged connection is lesser in fold resistance than the third hinged connection, or (ii) the second hinged connection is greater in fold resistance than the fourth hinged connection, or (iii) both (i) and (ii).

12. An article carrier according to claim 1 wherein the second primary panel comprises a first corner panel portion and a main panel portion, the first corner panel portion being hingedly connected to the first primary panel by the first hinged connection and to the main panel portion by a first corner hinged connection wherein: (i) the first hinged connection is lesser in fold resistance than the first corner hinged connection, or (ii) the first corner hinged connection is substantially equal in fold resistance to the second hinged connection, or (iii) both (i) and (ii).

13. An article carrier according to claim 12 wherein the second primary panel further comprises a second corner panel portion, the second corner panel portion being hingedly connected to the third primary panel by the second hinged connection and to the main panel portion by a second corner hinged connection wherein the second corner hinged connection is less in fold resistance than the second hinged connection.

14. An article carrier according to claim 12 wherein the fourth primary panel comprises an additional corner panel portion and a second main panel portion, the additional corner panel portion being hingedly connected to the third primary panel by the third hinged connection and to the second main panel portion by an additional corner hinged connection wherein the third hinged connection is greater in fold resistance than the additional corner hinged connection.

15. An article carrier according to claim 12 wherein the fourth primary panel comprises a further corner panel portion and a second main panel portion, the further corner panel portion being hingedly connected to the first primary panel by the fourth hinged connection and to the second main panel portion by a further corner hinged connection wherein the further corner hinged connection is greater in fold resistance than the fourth hinged connection.

16. An article carrier comprising a collapsible tubular structure which comprises a first primary panel, a second primary panel, a third primary panel and a fourth primary panel wherein the first and second primary panels are hingedly connected, the second and third primary panels are hingedly connected, the third and fourth primary panels are hingedly connected, the fourth and first primary panels are hingedly connected, wherein the second primary panel comprises a first corner panel portion and a main panel portion, the first corner panel portion being hingedly connected to the first primary panel by a first hinged connection and to the main panel portion by a first corner hinged connection, and wherein: (i) the first hinged connection comprises a working fold line and the first hinged connection is greater in fold resistance than the first corner hinged connection, or (ii) the first hinged connection comprises a non-working fold line and the first hinged connection is lesser in fold resistance than the first corner hinged connection.

17. A blank for forming an article carrier, the blank comprising a plurality of primary panels for forming walls of a tubular structure, the plurality of primary panels including: a first primary panel, a second primary panel, a third primary panel and a fourth primary panel wherein the first and second primary panels are hingedly connected, the second and third primary panels are hingedly connected, the third and fourth primary panels are hingedly connected, the fourth and first primary panels are hingedly connected, and wherein either: (i) a first hinged connection between the first and second primary panels is greater in fold resistance than each of a second hinged connection between the second and third primary panels and a fourth hinged connection between the fourth and first primary panels, or (ii) the first hinged connection is lesser in fold resistance than the second hinged connection and substantially equal in fold resistance to the fourth hinged connection.

18. A blank according to claim 17, wherein the second primary panel comprises a first corner panel portion and a main panel portion, the first corner panel portion being hingedly connected to the first primary panel by the first hinged connection and to the main panel portion by a first corner hinged connection wherein:

(i) the first hinged connection is greater in fold resistance than the first corner hinged connection, or (ii) the first corner hinged connection is substantially equal in fold resistance to the second hinged connection, or (iii) the first hinged connection is lesser in fold resistance than the first corner hinged connection, or (iv) both (i) and (ii), or (v) both (ii) and (iii).

19. A blank according to claim 17, wherein a third hinged connection between the third and fourth primary panels is greater in fold resistance than each of the second and fourth hinged connections.

20. A blank according to claim 17, wherein the second primary panel comprises a corner panel portion and a main panel portion, the corner panel portion being hingedly connected to the third primary panel by the second hinged connection and to the main panel portion by a corner hinged connection wherein the corner hinged connection is: (i) greater in fold resistance than the second hinged connection, or (ii) substantially equal in fold resistance to the first hinged connection, or (iii) less in fold resistance than the second hinged connection, or (iv) both (i) and (ii), or (v) both (ii) and (iii).

* * * * *